US012050037B2

(12) United States Patent
Wong

(10) Patent No.: US 12,050,037 B2
(45) Date of Patent: Jul. 30, 2024

(54) AIR CONDITIONING, HEAT PUMP AND WATER HEATING SYSTEM

(71) Applicant: Lee Wa Wong, Alhambra, CA (US)

(72) Inventor: Lee Wa Wong, Alhambra, CA (US)

( * ) Notice: Subject to any disclaimer, the term of this patent is extended or adjusted under 35 U.S.C. 154(b) by 0 days.

(21) Appl. No.: 18/264,156

(22) PCT Filed: Feb. 4, 2021

(86) PCT No.: PCT/US2021/016685

§ 371 (c)(1),
(2) Date: Aug. 3, 2023

(87) PCT Pub. No.: WO2022/169455

PCT Pub. Date: Aug. 11, 2022

(65) Prior Publication Data

US 2024/0044556 A1 Feb. 8, 2024

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01); *F25B 2313/02742* (2013.01)

(58) Field of Classification Search
CPC . F25B 41/20; F25B 13/00; F25B 2313/02742
See application file for complete search history.

(56) References Cited

U.S. PATENT DOCUMENTS 4,492,092 A * 1/1985 Smorol ..... F25B 13/00 62/181
5,050,394 A * 9/1991 Dudley ..... G05D 23/1931 62/183
2011/0061418 A1* 3/2011 Ishihara ..... F24H 15/174 165/53
2016/0091215 A1* 3/2016 Wong ..... F24F 5/001 62/160

* cited by examiner

*Primary Examiner* — Henry T Crenshaw
(74) *Attorney, Agent, or Firm* — Tsz Lung Yeung

(57) ABSTRACT

An air conditioning, heat pump and water heating system includes a compressor, a switching valve, an outdoor heat exchanger, a refrigerant storage tank, an indoor heat exchanger and a water heater. The air conditioning, heat pump and water heating system is configured to selectively operate between an air conditioning mode, a heat pump mode, a first water heating mode and a second water heating mode. In the first water heating mode, heat absorbed from an indoor space is utilized to heat up water circulating in the water heater so that when the air conditioning, heat pump and water heating system is operated in the first water heating mode, no heat is discharged to ambient environment. In the second water heating mode, heat absorbed from an ambient environment is utilized to heat up water circulating in the water heater.

32 Claims, 5 Drawing Sheets

AIR CONDITIONING, HEAT PUMP AND WATER HEATING SYSTEM

BACKGROUND OF THE PRESENT INVENTION

Field of Invention

The present invention relates to an air conditioning, heat pump and water heating system, and more particularly to an air conditioning, heat pump and water heating system configured to save a substantial amount of energy when compared with conventional air conditioning, heat pump and water heating system.

Description of Related Arts

One conventional method of producing heated water is by burning fossil fuel. This type of technology has produced a substantial amount of pollution and suffered from low energy efficiency. More recently, referring to FIG. 1 of the drawings, heated water may be produced by refrigeration system using electrical energy and refrigerant as medium of heat exchange. This type of water heating system comprises an outdoor heat exchanger 100P, a compressor 101P, and a water heater 102P. A predetermined amount of refrigerant may circulate between the outdoor heat exchanger 100P, the compressor 101P, and the water heater 102P. Refrigerant may absorb heat from the outdoor heat exchanger 100P and transfer the absorbed heat to the water flowing through the water heater.

There are several disadvantages in association with the above-mentioned refrigerant-type water heater. First, although the refrigerant-type water heater reduces a substantial amount of pollution related to burning of fossil fuel, energy efficiency remains low. Second, the refrigerant-type water heater described above is incapable of also providing air conditioning. Thus, during summer, a dwelling may need to be equipped with both the refrigerant-type water heater and an air conditioning system for separately providing heated water and cooled air. From technical perspective, the refrigerant-type water heater absorbs heat from ambient air and therefore make ambient air to become cooler. On the other hand, an air conditioning system releases heat to ambient air and therefore make ambient air to be warmer. These create substantial waste of energy.

Accordingly, there is a need to develop an air conditioning, heat pump and water heating system having relatively higher energy efficiency.

SUMMARY OF THE PRESENT INVENTION

Certain variations of the present invention provide an air conditioning, heat pump and water heating system configured to save a substantial amount of energy when compared with conventional air conditioning, heat pump and water heating system.

Certain variations of the present invention provide an air conditioning, heat pump and water heating system which is capable of selectively producing cooled air, warm air and heated water by a single system.

Certain variations of the present invention provide an air conditioning, heat pump and water heating system which utilizes heat in an indoor space to heat up water so as to minimize waste of energy when producing heated water.

In one aspect of the present invention, the present invention provides an air conditioning, heat pump and water heating system, comprising:

a plurality of connecting pipes;

at least one compressor having a compressor inlet and a compressor outlet;

a switching valve connected to the compressor inlet of the compressor through at least one of the connecting pipes;

an outdoor heat exchanger positioned in outdoor space and connected to the switching valve through at least one of the connecting pipes;

a refrigerant storage tank connected to the outdoor heat exchanger through at least one of the connecting pipes;

an indoor heat exchanging system connected to the outdoor heat exchanger and the refrigerant storage tank through at least one of the connecting pipes, the indoor heat exchanging system being arranged to perform heat exchange with a heat exchange medium circulating through an indoor device; and a water heater, which comprises:

a water tank having a water inlet and a water outlet; and a first water heat exchanger connected to the compressor outlet of the compressor through at least one of the connecting pipes, a predetermined amount of water flowing in the water tank through the water inlet and flowing out of the water tank through the water outlet;

the air conditioning, heat pump and water heating system being configured to selectively operate between at least an air conditioning mode and a heat pump mode, wherein in the air conditioning mode, a predetermined amount of vaporous refrigerant is arranged to leave the compressor and guided to enter the first water heat exchanger of the water heater for releasing heat to the water flowing through the water heater, the refrigerant leaving the water heater being guided to flow through the switching valve and reach the outdoor heat exchanger for releasing heat to ambient air, the refrigerant leaving the outdoor heat exchanger being guided to flow through the refrigerant storage tank and enter the indoor heat exchanging system for absorbing heat from the heat exchange medium circulating in the indoor heat exchanging system, the refrigerant leaving the indoor heat exchanging system being guided to flow back to the compressor to complete an air conditioning cycle, wherein in the heat pump mode, a predetermined amount of vaporous refrigerant is arranged to leave the compressor and guided to enter the first water heat exchanger of the water heater for releasing heat to the water flowing through the water heater, the refrigerant leaving the water heater being guided to flow through the switching valve and reach the indoor heat exchanging system for releasing heat to the heat exchange medium circulating in the indoor heat exchanging system, the refrigerant leaving the indoor heat exchanging system being guided to flow through the refrigerant storage tank and enter the outdoor heat exchanger for absorbing heat from the ambient air, the refrigerant leaving the outdoor heat exchanger being guided to flow back to the compressor to complete a heat pump cycle.

This summary is included so as to introduce various topics to be elaborated upon below in the detailed description of the preferred embodiment. This summary is not intended to identify key or essential aspects of the claimed invention. This summary is not intended for use as an aid in determining the scope of the claims.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection. Furthermore, "connected" may also mean direct connection or indirect connection, or connection through other auxiliary components. Moreover, "connection" or "connect" of two components may be accomplished through at least one connecting pipe. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Figure 1:
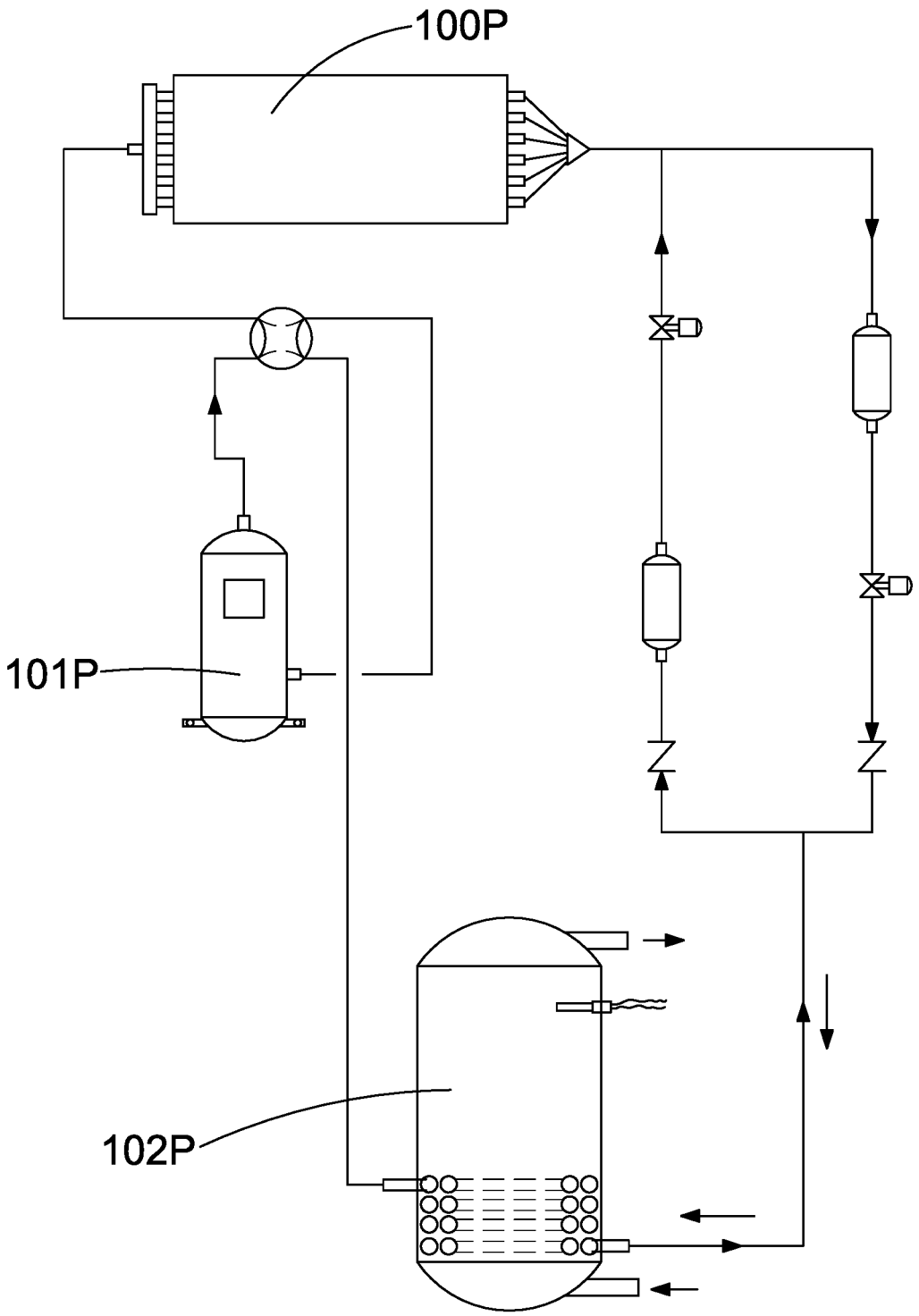
FIG.1 PRIOR ART
FIG. 1 is a conventional water heating system.
Figure 2:
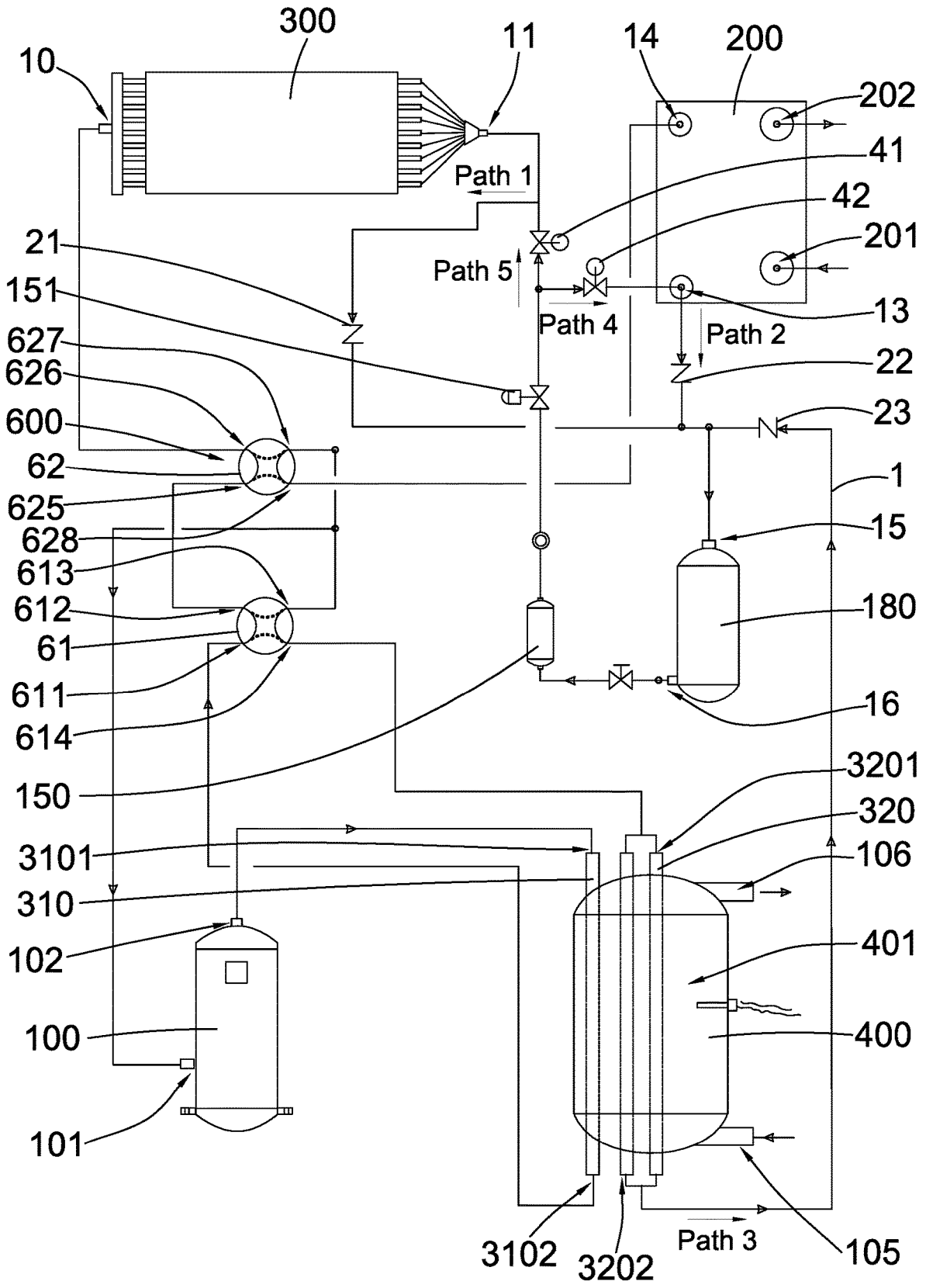
FIG. 2 is a schematic diagram of an air conditioning, heat pump and water heating system according to a first preferred embodiment of the present invention.

Referring to FIG. 2 of the drawings, an air conditioning, heat pump and water heating system according to a first preferred embodiment of the present invention is illustrated. Broadly, the air conditioning, heat pump and water heating system may comprise a plurality of connecting pipes 1, at least one compressor 100 having a compressor inlet 101 and a compressor outlet 102, a switching valve 600, an outdoor heat exchanger 300, an indoor heat exchanging system 200, a refrigerant storage tank 180, and a water heater 400. A predetermined amount of refrigerant may circulate through the various components described in this specification. The refrigerant may circulate through the various components through the plurality of connecting pipes 1.

The switching valve 600 may be connected to the compressor inlet 101 of the compressor 100 through at least one of the connecting pipes 1.

The outdoor heat exchanger 300 may be positioned in outdoor space and connected to the switching valve 600 through at least one of the connecting pipes 1.

The refrigerant storage tank 180 may be connected to the outdoor heat exchanger 300 through at least one of the connecting pipes 1.

The indoor heat exchanging system 200 may be connected to the outdoor heat exchanger 300 and the refrigerant storage tank 180 through at least one of the connecting pipes 1. The indoor heat exchanging system 200 may be arranged to perform heat exchange with a heat exchange medium circulating through an indoor device.

The water heater 400 may comprise a water tank 401 having a water inlet 105 connected to an external water supply and a water outlet 106 connected to a water consumption device, such as a faucet, a first water heat exchanger 310 and a second water heat exchanger 320.

The first water heat exchanger 310 may be connected to the compressor outlet 102 of the compressor 100 through at least one of the connecting pipes 1. A predetermined amount of water may flow in the water tank 401 through the water inlet 105 and flow out of the water tank 401 through the water outlet 106.

The air conditioning, heat pump and water heating system may be configured to selectively operate between at least an air conditioning mode and a heat pump mode, wherein in the air conditioning mode, a predetermined amount of vaporous refrigerant is arranged to leave the compressor 100 and guided to enter the first water heat exchanger 310 of the water heater 400 for releasing heat to the water flowing through the water heater 400, the refrigerant leaving the water heater may be guided to flow through the switching valve 600 and reach the outdoor heat exchanger 300 for releasing heat to ambient air. The refrigerant leaving the outdoor heat exchanger may be guided to flow through the refrigerant storage tank 180 and enter the indoor heat exchanging system 200 for absorbing heat from the heat exchange medium circulating in the indoor heat exchanging system 200. The refrigerant leaving the indoor heat exchanger 200 may be guided to flow back to the compressor 100 to complete an air conditioning cycle.

When the air conditioning, heat pump and water heating system is in the heat pump mode, a predetermined amount of vaporous refrigerant may be arranged to leave the compressor 100 and guided to enter the first water heat exchanger 310 of the water heater 400 for releasing heat to the water flowing through the water heater 400. The refrigerant leaving the water heater 400 may be guided to flow through the switching valve 600 and reach the indoor heat exchanging system 200 for releasing heat to the heat exchange medium circulating in the indoor heat exchanging system 200. The refrigerant leaving the indoor heat exchanging system 200 may be guided to flow through the refrigerant storage tank 180 and enter the outdoor heat exchanger 300 for absorbing heat from the ambient air. The refrigerant leaving the outdoor heat exchanger 300 may be being guided to flow back to the compressor 100 to complete a heat pump cycle.

The above-mentioned components may be connected to form a particular configuration to allow refrigerant to perform heat exchange with various mediums such as ambient air. An exemplary configuration is shown in FIG. 2 of the drawings. According to the first preferred embodiment of the present invention, the outdoor heat exchanger 300 may be positioned in an outdoor environment so that it may draw ambient air for performing heat exchange with the refrigerant.

According to the first preferred embodiment of the present invention, the second water heat exchanger 320 may be connected to the switching valve 600, the refrigerant storage tank 180, the outdoor heat exchanger 300 and the indoor heat exchanging system 200 through at least one of the connecting pipes 1.

The air conditioning, heat pump and water heating system may also be configured to further selectively operate in a first water heating mode and a second water heating mode in addition to the air conditioning mode and the heat pump mode mentioned above. When the air conditioning, heat pump and water heating system operates in the first water heating mode, a predetermined amount of vaporous refrigerant may be arranged to leave the compressor and guided to enter the first water heat exchanger 310 of the water heater 400 for releasing heat to the water flowing through the water heater 400. The refrigerant leaving the first water heat exchanger 310 may be guided to flow through the second water heat exchanger 320 for further releasing heat to the water flowing through the water heater 400. The refrigerant leaving the second water heat exchanger 320 may be guided to flow through the refrigerant storage tank 180 and enter the indoor heat exchanging system 200 for absorbing heat from the heat exchange medium circulating in the indoor heat exchanging system 200. The refrigerant leaving the indoor heat exchanging system 200 may be guided to flow back to the compressor 100 to complete a first water heating cycle. In this first water heating mode, heat in the indoor space may be utilized to heat up the water flowing in the water heater 400.

When the air conditioning, heat pump and water heating system operates in the second water heating mode, a predetermined amount of vaporous refrigerant is arranged to leave the compressor 100 and guided to enter the first water heat exchanger 310 of the water heater 400 for releasing heat to the water flowing through the water heater 400. The refrigerant leaving the first water heat exchanger 310 may be guided to flow through the second water heat exchanger 320 for further releasing heat to the water flowing through the water heater 400. The refrigerant leaving the second water heat exchanger 320 may be guided to flow through the refrigerant storage tank 180 and enter the outdoor heat exchanger 300 for absorbing heat from the ambient air. The refrigerant leaving the outdoor heat exchanger 300 may be guided to flow back to the compressor 100 to complete a second water heating cycle. In his second water heating mode, heat from ambient environment may be absorbed and utilized to heat up water in the water heater 400.

The switching valve 600 may comprise a first four-way valve 61 and a second four-way valve 62. The first four-way valve 61 may have first through fourth connecting port 611, 612, 613, 614. The first four-way valve 61 may be switched between a first operating mode and a second operating mode, wherein in the first operating mode, first four-way valve 61 is switched such that the first connecting port 611 may be connected to the second connecting port 612 so that refrigerant may flow from the first connecting port 611 to the second connecting port 612, while the third connecting port 613 may be connected to the fourth connecting port 614 so that refrigerant may flow from the third connecting port 613 to the fourth connecting port 614.

In the second operating mode, the first four-way valve 61 may be switched so that the first connecting port 611 may be connected to the fourth connecting port 614 so that refrigerant may flow from the first connecting port 611 to the fourth connecting port 614, while the second connecting port 612 may be connected to the third connecting port 613, so that refrigerant may flow from the second connecting port 612 to the third connecting port 613.

On the other hand, the second four-way valve 62 may have fifth through eighth connecting port 625, 626, 627, 628. The second four-way valve 62 may be switched between a third operating mode and a fourth operating mode, wherein in the third operating mode, the second four-way valve 62 may be switched such that the fifth connecting port 625 may be connected to the sixth connecting port 626 so that refrigerant may flow from the fifth connecting port 625 to the sixth connecting port 626, while the seventh connecting port 627 may be connected to the eighth connecting port 628 so that refrigerant may flow from the seventh connecting port 627 to the eighth connecting port 628.

In the fourth operating mode, the second four-way valve 62 may be switched so that the fifth connecting port 625 may be connected to the eighth connecting port 628 so that refrigerant may flow from the fifth connecting port 625 to the eighth connecting port 628, while the sixth connecting port 626 may be connected to the seventh connecting port 627, so that refrigerant may flow from the sixth connecting port 626 to the seventh connecting port 627.

The outdoor heat exchanger 300 may have a first communicating port 10 and a second communicating port 11 for allowing refrigerant to flow into or out of the outdoor heat exchanger 300. As shown in FIG. 2 of the drawings, the first communicating port 10 may be connected to the sixth connecting port 626 of the second four-way valve 62. The second communicating port 11 may be connected to the refrigerant storage tank 180, the indoor heat exchanging system 200, and the water heater 400 through various other components (described below). The refrigerant flowing through the outdoor heat exchanger 300 may be arranged to perform heat exchange with the ambient air. The outdoor heat exchanger 300 may be configured to have a plurality of heat exchanging tubes and a plurality of heat exchanging fins for enhancing heat exchange performance of the outdoor heat exchanger 300. The seventh connecting port 627 may be connected to the compressor inlet 101 of the compressor 100.

The indoor heat exchanging system 200 may be utilized for performing heat exchange with another heat exchange medium circulating in an indoor heat distribution system. In this first preferred embodiment of the present invention, the indoor heat exchanging system 200 may be configured as a heat exchanger arranged to perform heat exchange between refrigerant and water circulating in an indoor heat distribution system. The water may carry away or bring heat to designated indoor spaces through the water flowing through the indoor heat exchanging system 200.

Thus, the indoor heat exchanging system 200 may have a first passage port 13 and a second passage port 14 for allowing refrigerant to flow into or out of the indoor heat exchanging system 200. The first passage port 13 may be connected to the second communicating port 11 of the outdoor heat exchanger 300, the refrigerant storage tank 180, and the water heater 400 through other auxiliary components (described below). The second passage port 14 may be connected to the eighth connecting port 628 of the second four-way value 62.

The indoor heat exchanging system 200 may further have a first heat distribution port 201 and a second heat distribution port 202 for allowing the another heat exchange medium to enter or flow out of the indoor heat exchanging system 200.

The refrigerant storage tank 180 may have a liquid inlet 15 connected to the second communicating port 11 of the outdoor heat exchanger 300, the first passage port 13 of the indoor heat exchanging system 200, and the second water heat exchanger 320 of the water heater 400 through a plurality of auxiliary components (described below). The refrigerant storage tank 180 may further have a liquid outlet 16 connected to the second communicating port 11 and the first passage port 13 of the indoor heat exchanging system 200 through a plurality of auxiliary components (described below). The refrigerant storage tank 180 may be utilized for temporarily store a predetermined amount of refrigerant.

The air conditioning, heat pump and water heating system may further comprise a filter 150 connected to the liquid outlet 16 of the refrigerant storage tank 180, and an expansion valve 151 connected to the filter 150 in series. These are two of the auxiliary components described above.

The air conditioning, heat pump and water heating system may further comprise a first unidirectional valve 21 for restricting the flow of the refrigerant in one predetermined direction. As shown in FIG. 2 of the drawings, the first unidirectional valve 21 may be connected between the second communicating port 11 of the outdoor heat exchanger 300 and the liquid inlet 15 of the refrigerant storage tank 180. The first unidirectional valve 21 may be configured to allow a flow of refrigerant only in a direction from the second communicating port 11 of the outdoor heat exchanger 300 toward the liquid inlet 15 of the refrigerant storage tank 180, through Path 1 indicated in FIG. 2 of the drawings.

On the other hand, the air conditioning, heat pump and water heating system may further comprise a second unidirectional valve 22 for restricting the flow of the refrigerant in one predetermined direction. As shown in FIG. 2 of the drawings, the second unidirectional valve 22 may be connected between the first passage port 13 of the indoor heat exchanging system 200 and the liquid inlet 15 of the refrigerant storage tank 180. The second unidirectional valve 22 may be configured to allow a flow of refrigerant only in a direction from the first passage port 13 of the indoor heat exchanging system 200 toward the liquid inlet 15 of the refrigerant storage tank 180, through Path 2 indicated in FIG. 2 of the drawings.

The air conditioning, heat pump and water heating system may further comprise a third unidirectional valve 23 for restricting the flow of the refrigerant in one predetermined direction. The third unidirectional valve 23 may be connected between the second water heat exchanger 320 of the water heater 400 and the liquid inlet 15 of the refrigerant storage tank 180. The third unidirectional valve 23 may be configured to allow a flow of refrigerant only in a direction from the second water heat exchanger 320 of the water heater 400 toward the liquid inlet 15 of the refrigerant storage tank 180, through Path 3 indicated in FIG. 2 of the drawings.

From the configuration shown in FIG. 2 of the drawings, refrigerant coming from the second communicating port 11 of the outdoor heat exchanger 300, the first passage port 13 of the indoor heat exchanging system 200, and the second water heat exchanger 320 of the water heater 400 may be guided to flow into the refrigerant storage tank 180 through the liquid inlet 15 and by the use of the first unidirectional valve 21, the second unidirectional valve 22, and the third unidirectional valve 23 respectively (see Path 1 to Path 3 indicated in FIG. 2).

The air conditioning, heat pump and water heating system may further comprise a first electrically-controlled two-way valve 41 connected to the second communicating port 11 of the outdoor heat exchanger 300 and the liquid outlet 16 of the refrigerant storage tank 180 through the filter 150 and the expansion valve 151 in Path 5 indicated in FIG. 2 of the drawings. The first electrically-controlled two-way valve 41 and the first unidirectional valve 21 may both be connected to the second communicating port 11 of the outdoor heat exchanger 300. The first electrically-controlled two-way valve 41 and the first unidirectional valve 21 may be connected in parallel.

The air conditioning, heat pump and water heating system may further comprise a second electrically-controlled two-way valve 42 connected to the first passage port 13 of the indoor heat exchanging system 200 and the first electrically-controlled two-way valve 41 and the expansion valve 151. The second electrically-controlled two-way valve 42 may be connected in Path 4 as indicated in FIG. 2 of the drawings. Refrigerant flowing from the liquid outlet 16 may be selectively guided to flow through the filter 150, the expansion valve 151, the second electrically-controlled two-way valve 42 and eventually reach the indoor heat exchanging system 200.

Each of the first electrically-controlled two-way valve 41 and the second electrically-controlled two-way valve 42 may be selectively switched off for not allowing refrigerant to pass therethrough. Each of the first electrically-controlled two-way valve 41 and the second electrically-controlled two-way valve 42 may also be selectively switched on for allowing refrigerant to pass therethrough in a predetermined direction.

When the air conditioning, heat pump and water heating system is in the air conditioning mode, the first four-way valve 61 may be switched to the first operating mode, while the second four-way valve 62 may be switched to the third operating mode. The first electrically-controlled two-way valve 41 may be turned off while the second electrically-controlled two-way valve 42 may be turned on.

Referring to FIG. 2 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102.

The refrigerant leaving the first water heat exchanger 310 may be guided to pass through the first connecting port 611, the second connecting port 612, the fifth connecting port 625 and the sixth connecting port 626 of the second four-way valve 62, and enter the first communicating port 10 of the outdoor heat exchanger 300. The refrigerant may release heat to the ambient air when passing through the outdoor heat exchanger 300. The refrigerant may then be guided to leave the outdoor heat exchanger 300 through the second communicating port 11 and may be guided to pass through first unidirectional valve 21 in Path 1 and enter the refrigerant storage tank 180 through the liquid inlet 15. The refrigerant may then leave the refrigerant storage tank 180 through the liquid outlet 16 and may be guided to flow through the filter 150, the expansion valve 151, the second electrically-controlled two-way valve 42 in Path 4, and enter the indoor heat exchanging system 200 through the first passage port 13. The refrigerant may then absorb heat from another heat exchange medium circulating in the indoor heat exchanging system 200. The another heat exchange medium carries heat from the designated indoor spaces.

The refrigerant may then be arranged to leave the indoor heat exchanging system 200 through the second passage port 14 and pass through the eighth connecting port 628 and the seventh connecting port 627 of the second four-way valve 62, and eventually flow back to the compressor 100 through the compressor inlet 101 to complete an air conditioning cycle.

When the air conditioning, heat pump and water heating system is in the heat pump mode, the first four-way valve 61 may be switched to the first operating mode, while the second four-way valve 62 may be switched to the fourth operating mode. The first electrically-controlled two-way valve 41 may be turned on while the second electrically-controlled two-way valve 42 may be turned off.

Referring to FIG. 2 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102.

The refrigerant leaving the first water heat exchanger 310 may be guided to pass through the first connecting port 611, the second connecting port 612, the fifth connecting port 625 and the eighth connecting port 628 of the second four-way valve 62, and enter the second passage port 14 of the indoor heat exchanging system 200. The refrigerant may release heat to the another heat exchange medium circulating in the indoor heat exchanging system 200. The refrigerant may then be guided to leave the indoor heat exchanging system 200 through the first passage port 13 and may then be guided to pass through second unidirectional valve 22 in Path 2 and enter the refrigerant storage tank 180 through the liquid inlet 15. The refrigerant may then leave the refrigerant storage tank 180 through the liquid outlet 16 and may be guided to flow through the filter 150, the expansion valve 151, the first electrically-controlled two-way valve 41 in Path 5, and enter the outdoor heat exchanger 300 through the second communicating port 11. The refrigerant may then absorb heat from ambient air when passing through the outdoor heat exchanger 300.

The refrigerant may then be arranged to leave the outdoor heat exchanger 300 through the first communicating port 10 and pass through the sixth connecting port 626 and the seventh connecting port 627 of the second four-way valve 62, and eventually flow back to the compressor 100 through the compressor inlet 101 to complete a heat pump cycle.

When the air conditioning, heat pump and water heating system is in the first water heating mode, the first four-way valve 61 may be switched to the second operating mode, while the second four-way valve 62 may be switched to the fourth operating mode. The first electrically-controlled two-way valve 41 may be turned off while the second electrically-controlled two-way valve 42 may be turned on.

Referring to FIG. 2 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102. The refrigerant leaving the first water heat exchanger 310 may be guided to pass through the first connecting port 611, the fourth connecting port 614, and enter the second water heat exchanger 320 through a second entry port 3201 for further releasing a certain amount of heat to the water flowing in the water heater 400. The refrigerant may then be arranged to leave the second water heat exchanger 320 through a second exit port 3202 and may be guided to pass through the third unidirectional valve 23 in Path 3, and enter the refrigerant storage tank 180 through the liquid inlet 15. The refrigerant may then leave the refrigerant storage tank 180 through the liquid outlet 16 and may be guided to flow through the filter 150, the expansion valve 151, the second electrically-controlled two-way valve 42 in Path 4, and enter the indoor heat exchanging system 200 through the first passage port 13. The refrigerant may then absorb heat from the another heat exchange medium, which absorbs heat from the indoor spaces. Thus, the refrigerant may use the heat absorbed in the indoor spaces as a heat source to heat up the water in the water heater 400.

The refrigerant may then be arranged to leave the indoor heat exchanging system 200 through the second passage port 14 and pass through the eighth connecting port 628 and the fifth connecting port 625 of the second four-way valve 62, and the second connecting port 612 and the third connecting port 613 of the first four-way valve 61, and eventually flow back to the compressor 100 through the compressor inlet 101 to complete a first water heating cycle.

It is worth mentioning that in this first water heating cycle, the outdoor heat exchanger 300 may become idle. Therefore, residual refrigerant in the outdoor heat exchanger 300 may be guided to flow back to the compressor 100 through the sixth connecting port 626 and the seventh connecting port 627 of the second four-way valve 62.

When the air conditioning, heat pump and water heating system is in the second water heating mode, the first four-way valve 61 may be switched to the first operating mode, while the second four-way valve 62 may be switched to the fourth operating mode. The first electrically-controlled two-way valve 41 may be turned on while the second electrically-controlled two-way valve 42 may be turned off.

Referring to FIG. 2 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102. The refrigerant leaving the first water heat exchanger 310 may be guided to pass through the first connecting port 611, the fourth connecting port 614, and enter the second water heat exchanger 320 through a second entry port 3201 for further releasing a certain amount of heat to the water flowing in the water heater 400.

The refrigerant may then be arranged to leave the second water heat exchanger 320 through a second exit port 3202 and may be guided to pass through the third unidirectional valve 23 in Path 3, and enter the refrigerant storage tank 180 through the liquid inlet 15. The refrigerant may then leave the refrigerant storage tank 180 through the liquid outlet 16 and may be guided to flow through the filter 150, the expansion valve 151, the first electrically-controlled two-way valve 41 in Path 5, and enter the outdoor heat exchanging system 300 through the second communicating port 11. The refrigerant may then absorb heat from ambient air flowing through the outdoor heat exchanging system 300. Thus, the refrigerant may use the heat from ambient air as a heat source to heat up the water in the water heater 400.

The refrigerant may then be arranged to leave the outdoor heat exchanger 300 through the first communicating port 10 and pass through the sixth connecting port 626 and the seventh connecting port 627 of the second four-way valve 62, and eventually flow back to the compressor 100 through the compressor inlet 101 to complete a second water heating cycle.

It is also worth mentioning that all of the air conditioning mode, the heat pump mode, the first water heating mode and the second water heating mode may be utilized to produce heated water in the water heater 400. However, in the former two modes of operations, supply of heated water may be less than that of the latter two modes.

Figure 3:
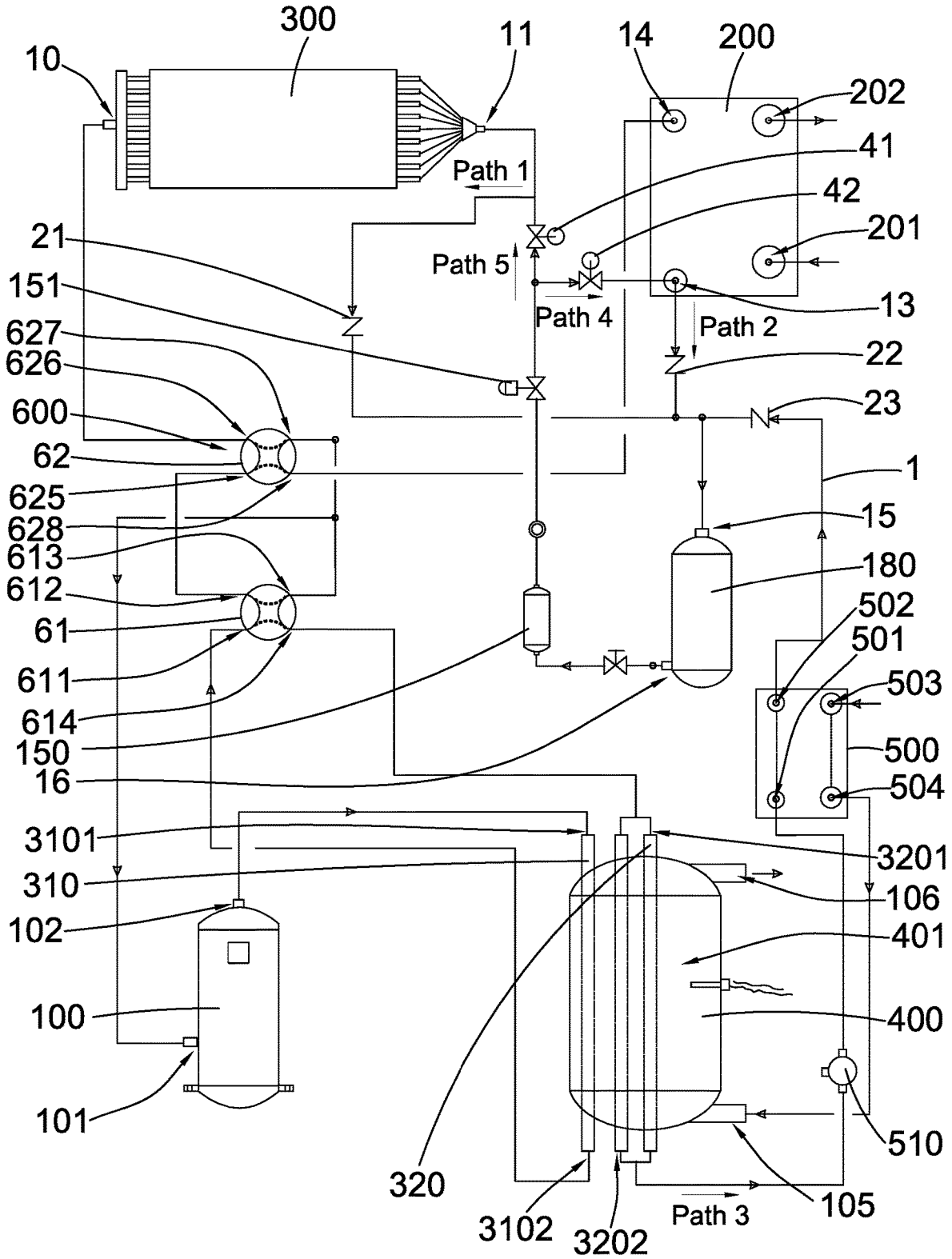
FIG. 3 is a schematic diagram of an air conditioning, heat pump and water heating system according to a first alternative mode of the first preferred embodiment of the present invention.

Referring to FIG. 3 of the drawings, an alternative mode of the air conditioning, heat pump and water heating system according to the first preferred embodiment of the present invention is illustrated. The alternative mode is identical to the configuration described in the first preferred embodiment, except the air conditioning, heat pump and water heating system may further comprise an energy saving heat exchanger 500 connected between the water heater 400 and the refrigerant storage tank 180.

The energy saving heat exchanger 500 may have a first refrigerant port 501 connected to the second exit port 3202 of the second water heat exchanger 320 of the water heater 400, a second refrigerant port 502 connected to the liquid inlet 15 of the refrigerant storage tank 180 through the third unidirectional valve 23, a first water port 503 connected to an external water supply, and a second water port 504 connected to the water inlet 105 of the water heater 400. The water outlet 106 of the water heater 400 may also be connected to a water consumption device.

Moreover, the air conditioning, heat pump and water heating system may further comprise a depressurizing device 510 connected between the second exit port 3202 of the second water heat exchanger 320 and the first refrigerant port 501 for decreasing a pressure of the refrigerant flowing through the depressurizing device 510.

The purpose of having the energy saving heat exchanger 500 is to utilize the temperature of an external water source (such as water from a public water supply system) to lower the temperature of the refrigerant passing through the energy saving heat exchanger 500. At the same time, water may be pre-heated by the refrigerant before entering the water heater 400. This is an improvement over the first preferred embodiment described above because in the first preferred embodiment as shown in FIG. 2 of the drawings, the power source of the heat exchange may solely be provided by the work done by the compressor 100. However, in this alternative mode, additional heat exchange may occur because of the inherent temperature difference between an external water source and the refrigerant.

The air conditioning, heat pump and water heating system in this alternative mode may also be operated between the air conditioning mode, the heat pump mode, the first water heating mode and the second water heating mode. When the air conditioning, heat pump and water heating system is in the air conditioning mode, the first four-way valve 61 may be switched to the first operating mode, while the second four-way valve 62 may be switched to the third operating mode. The first electrically-controlled two-way valve 41 may be turned off while the second electrically-controlled two-way valve 42 may be turned on.

Referring to FIG. 3 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102.

The refrigerant leaving the first water heat exchanger 310 may be guided to pass through the first connecting port 611, the second connecting port 612, the fifth connecting port 625 and the sixth connecting port 626 of the second four-way valve 62, and enter the first communicating port 10 of the outdoor heat exchanger 300. The refrigerant may release heat to the ambient air when passing through the outdoor heat exchanger 300. The refrigerant may then be guided to leave the outdoor heat exchanger 300 through the second communicating port 11 and may be guided to pass through first unidirectional valve 21 in Path 1 and enter the refrigerant storage tank 180 through the liquid inlet 15. The refrigerant may then leave the refrigerant storage tank 180 through the liquid outlet 16 and may be guided to flow through the filter 150, the expansion valve 151, the second electrically-controlled two-way valve 42 in Path 4, and enter the indoor heat exchanging system 200 through the first passage port 13. The refrigerant may then absorb heat from another heat exchange medium circulating in the indoor heat exchanging system 200. The another heat exchange medium carries heat from the designated indoor spaces.

The refrigerant may then be arranged to leave the indoor heat exchanging system 200 through the second passage port 14 and pass through the eighth connecting port 628 and the seventh connecting port 627 of the second four-way valve 62, and eventually flow back to the compressor 100 through the compressor inlet 101 to complete an air conditioning cycle.

When the air conditioning, heat pump and water heating system in the first alternative mode is in the heat pump mode, the first four-way valve 61 may be switched to the first operating mode, while the second four-way valve 62 may be switched to the fourth operating mode. The first electrically-controlled two-way valve 41 may be turned on while the second electrically-controlled two-way valve 42 may be turned off.

Referring to FIG. 3 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102.

The refrigerant leaving the first water heat exchanger 310 may be guided to pass through the first connecting port 611, the second connecting port 612, the fifth connecting port 625 and the eighth connecting port 628 of the second four-way valve 62, and enter the second passage port 14 of the indoor heat exchanging system 200. The refrigerant may release heat to the another heat exchange medium circulating in the indoor heat exchanging system 200. The refrigerant may then be guided to leave the indoor heat exchanging system 200 through the first passage port 13 and may then be guided to pass through second unidirectional valve 22 in Path 2 and enter the refrigerant storage tank 180 through the liquid inlet 15. The refrigerant may then leave the refrigerant storage tank 180 through the liquid outlet 16 and may be guided to flow through the filter 150, the expansion valve 151, the first electrically-controlled two-way valve 41 in Path 5, and enter the outdoor heat exchanger 300 through the second communicating port 11. The refrigerant may then absorb heat from ambient air when passing through the outdoor heat exchanger 300.

The refrigerant may then be arranged to leave the outdoor heat exchanger 300 through the first communicating port 10 and pass through the sixth connecting port 626 and the seventh connecting port 627 of the second four-way valve 62, and eventually flow back to the compressor 100 through the compressor inlet 101 to complete a heat pump cycle.

Broadly, when the air conditioning, heat pump and water heating system in the first alternative mode of the first preferred embodiment is in the first water heating mode, a predetermined amount of vaporous refrigerant may be arranged to leave the compressor and guided to enter the first water heat exchanger 310 of the water heater 400 for releasing heat to the water flowing through the water heater 400. The refrigerant leaving the first water heat exchanger 310 may be guided to flow through the second water heat exchanger 320 for further releasing heat to the water flowing through the water heater 400. The refrigerant leaving the second water heat exchanger 320 may be guided to flow through the energy saving heat exchanger 500 for releasing heat to the water flowing therethrough. The refrigerant leaving the energy saving heat exchanger 500 may be guided to flow through the refrigerant storage tank 180 and enter the indoor heat exchanging system 200 for absorbing heat from the heat exchange medium circulating in the indoor heat exchanging system 200. The refrigerant leaving the indoor heat exchanging system 200 may be guided to flow back to the compressor 100 to complete a first water heating cycle. In this first water heating mode, heat in the indoor space may be utilized to heat up the water flowing in the water heater 400.

More specifically, in the first water heating mode, the first four-way valve 61 may be switched to the second operating mode, while the second four-way valve 62 may be switched to the fourth operating mode. The first electrically-controlled two-way valve 41 may be turned off while the second electrically-controlled two-way valve 42 may be turned on.

Referring to FIG. 3 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102. The refrigerant leaving the first water heat exchanger 310 may be guided to pass through the first connecting port 611, the fourth connecting port 614, and enter the second water heat exchanger 320 through a second entry port 3201 for further releasing a certain amount of heat to the water flowing in the water heater 400. The refrigerant may then be arranged to leave the second water heat exchanger 320 through a second exit port 3202, and may then be guided to pass through the depressurizing device 510, and enter the energy saving heat exchanger 500 through the first refrigerant port 501. The refrigerant may be perform heat exchange with the water flowing in the energy saving heat exchanger 500 for releasing heat thereto. The refrigerant may then leave the energy saving heat exchanger 500 through the second refrigerant port 502 and pass through the third unidirectional valve 23 in Path 3, and enter the refrigerant storage tank 180 through the liquid inlet 15. The refrigerant may then leave the refrigerant storage tank 180 through the liquid outlet 16 and may be guided to flow through the filter 150, the expansion valve 151, the second electrically-controlled two-way valve 42 in Path 4, and enter the indoor heat exchanging system 200 through the first passage port 13. The refrigerant may then absorb heat from the another heat exchange medium, which absorbs heat from the indoor spaces. Thus, the refrigerant may use the heat absorbed in the indoor spaces as a heat source to heat up the water in the water heater 400.

The refrigerant may then be arranged to leave the indoor heat exchanging system 200 through the second passage port 14 and pass through the eighth connecting port 628 and the fifth connecting port 625 of the second four-way valve 62, and the second connecting port 612 and the third connecting port 613 of the first four-way valve 61, and eventually flow back to the compressor 100 through the compressor inlet 101 to complete a first water heating cycle.

On the other hand, water from an external water source may be guided to enter the energy saving heat exchanger 500 through the first water port 503. The water may perform heat exchange with the refrigerant passing through the energy saving heat exchanger 500 and absorb heat from the refrigerant. Thus, the water may be preheated before entering the water heater 400. The water may then leave the energy saving heat exchanger 500 through the second water port 504 and enter the water heater 400 through the water inlet 105. The water may further be heated by the first water heat exchanger 310 and/or the second water heat exchanger 320 and exit the water heater 400 through the water outlet 106 for consumption by users.

It is worth mentioning that in this first water heating cycle, the outdoor heat exchanger 300 may become idle. Therefore, residual refrigerant in the outdoor heat exchanger 300 may be guided to flow back to the compressor 100 through the sixth connecting port 626 and the seventh connecting port 627 of the second four-way valve 62.

When the air conditioning, heat pump and water heating system in the alternative mode of the first preferred embodiment is in the second water heating mode, a predetermined amount of vaporous refrigerant is arranged to leave the compressor 100 and guided to enter the first water heat exchanger 310 of the water heater 400 for releasing heat to the water flowing through the water heater 400. The refrigerant leaving the first water heat exchanger 310 may be guided to flow through the second water heat exchanger 320 for further releasing heat to the water flowing through the water heater 400. The refrigerant leaving the second water heat exchanger 320 may be guided to flow through the energy saving heat exchanger 500 for releasing heat to the water flowing therethrough. The refrigerant leaving the energy saving heat exchanger 500 may be guided to flow through the refrigerant storage tank 180 and enter the outdoor heat exchanger 300 for absorbing heat from the ambient air. The refrigerant leaving the outdoor heat exchanger 300 may be guided to flow back to the compressor 100 to complete a second water heating cycle. In his second water heating mode, heat from ambient environment may be absorbed and utilized to heat up water in the water heater 400.

Specifically in the second water heating mode, the first four-way valve 61 may be switched to the first operating mode, while the second four-way valve 62 may be switched to the fourth operating mode. The first electrically-controlled two-way valve 41 may be turned on while the second electrically-controlled two-way valve 42 may be turned off.

Referring to FIG. 3 the drawings, a predetermined amount of vaporous refrigerant is arranged to leave the compressor 100 through the compressor outlet 102 and may be guided to enter the first water heat exchanger 310 through a first entry port 3101 for releasing a certain amount of heat to the water flowing in the water heater 400. The refrigerant may then be guided to leave the first water heat exchanger 310 through a first exit port 3102. The refrigerant leaving the first water heat exchanger 310 may be guided to pass through the first connecting port 611, the fourth connecting port 614, and enter the second water heat exchanger 320 through a second entry port 3201 for further releasing a certain amount of heat to the water flowing in the water heater 400.

The refrigerant may then be arranged to leave the second water heat exchanger 320 through a second exit port 3202, and may then be guided to pass through the depressurizing device 510, and enter the energy saving heat exchanger 500 through the first refrigerant port 501. The refrigerant may then perform heat exchange with the water flowing in the energy saving heat exchanger 500 for releasing heat thereto. The refrigerant may then leave the energy saving heat exchanger 500 through the second refrigerant port 502 and pass through the third unidirectional valve 23 in Path 3, and enter the refrigerant storage tank 180 through the liquid inlet 15. The refrigerant may then leave the refrigerant storage tank 180 through the liquid outlet 16 and may be guided to flow through the filter 150, the expansion valve 151, the first electrically-controlled two-way valve 41 in Path 5, and enter the outdoor heat exchanging system 300 through the second communicating port 11. The refrigerant may then absorb heat from ambient air flowing through the outdoor heat exchanging system 300. Thus, the refrigerant may use the heat from ambient air as a heat source to heat up the water in the water heater 400.

The refrigerant may then be arranged to leave the outdoor heat exchanger 300 through the first communicating port 10 and pass through the sixth connecting port 626 and the seventh connecting port 627 of the second four-way valve 62, and eventually flow back to the compressor 100 through the compressor inlet 101 to complete a second water heating cycle.

Water from an external water source may be guided to enter the energy saving heat exchanger 500 through the first water port 503. The water may perform heat exchange with the refrigerant passing through the energy saving heat exchanger 500 and absorb heat from the refrigerant. Thus, the water may be preheated before entering the water heater 400. The water may then leave the energy saving heat exchanger 500 through the second water port 504 and enter the water heater 400 through the water inlet 105. The water may further be heated by the first water heat exchanger 310 and/or the second water heat exchanger 320 and exit the water heater 400 through the water outlet 106 for consumption by users.

It is also worth mentioning that all of the air conditioning mode, the heat pump mode, the first water heating mode and the second water heating mode may be utilized to produce heated water in the water heater 400. However, in the former two modes of operations, supply of heated water may be less than that of the latter two modes.

Figure 4:
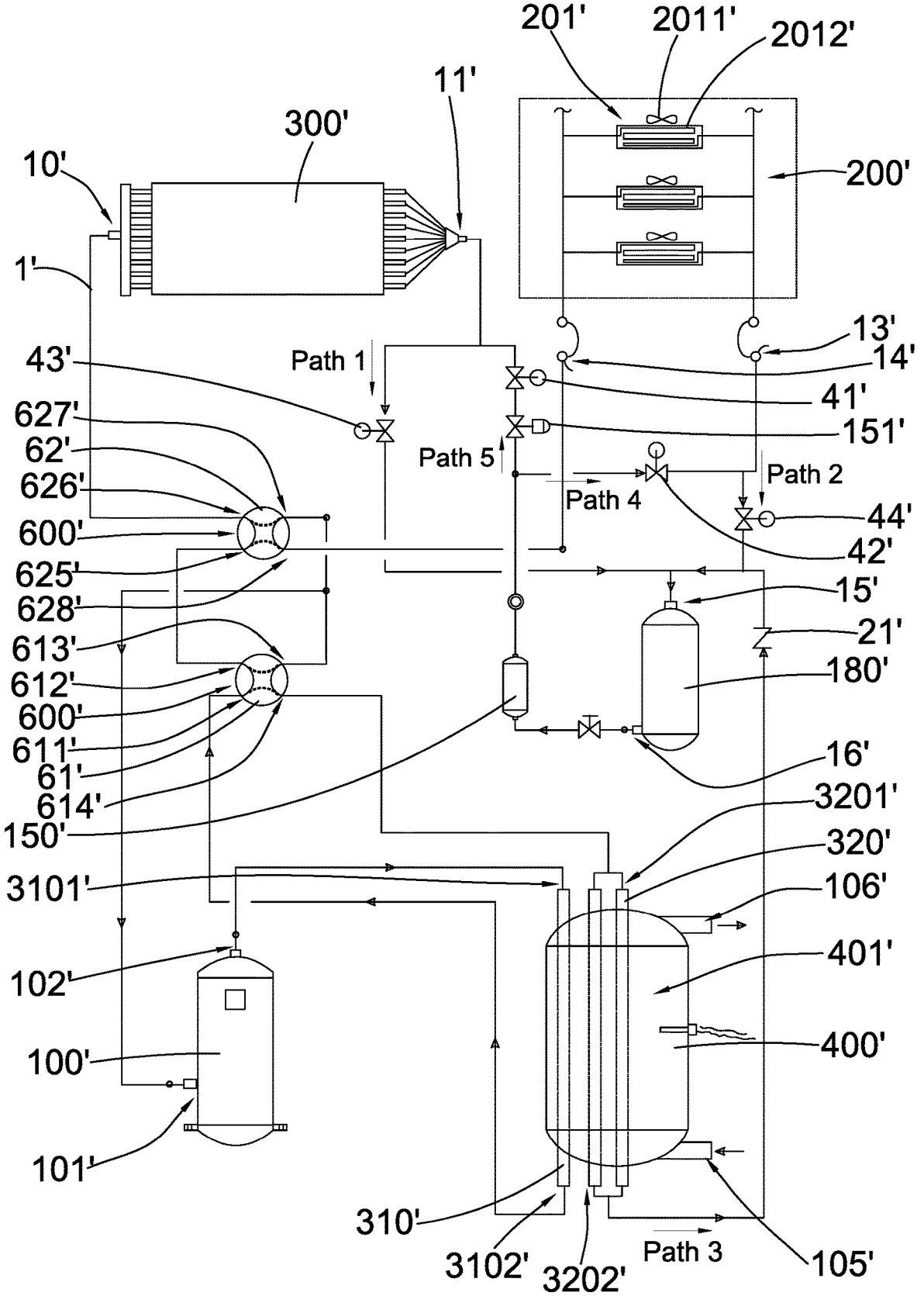
FIG. 4 is a schematic diagram of an air conditioning, heat pump and water heating system according to a second preferred embodiment of the present invention.

Referring to FIG. 4 of the drawings, an air conditioning, heat pump and water heating system according to a second preferred embodiment of the present invention is illustrated. The second preferred embodiment is very similar to the first preferred embodiment, except the indoor heat exchanging system 200' and its connections with other components. In the second preferred embodiment of the present invention, the indoor heat exchanging system 200' may comprise a plurality of fan coils units (FCU) 201' connected in parallel. The indoor heat exchanging system 200' may have a first passage port 13' and a second passage port 14' for allowing refrigerant to be supplied and exit from the fan coil units 201'

The air conditioning, heat pump and water heating system in the second preferred embodiment may comprise a plurality of connecting pipes 1', at least one compressor 100' having a compressor inlet 101' and a compressor outlet 102', a switching valve 600', an outdoor heat exchanger 300', an indoor heat exchanging system 200', a refrigerant storage tank 180', and a water heater 400'. A predetermined amount of refrigerant may circulate through the various components described in this specification. The refrigerant may circulate through the various components through the plurality of connecting pipes 1'.

The switching valve 600' may be connected to the compressor inlet 101' of the compressor 100' through at least one of the connecting pipes 1'.

The outdoor heat exchanger 300' may be positioned in outdoor space and connected to the switching valve 600' through at least one of the connecting pipes 1'.

The refrigerant storage tank 180' may be connected to the outdoor heat exchanger 300' through at least one of the connecting pipes 1'.

The indoor heat exchanging system 200' may be connected to the outdoor heat exchanger 300' and the refrigerant storage tank 180' through at least one of the connecting pipes 1'. The indoor heat exchanging system 200' may be arranged to perform heat exchange with a heat exchange medium circulating through an indoor device.

The water heater 400' may comprise a water tank 401' having a water inlet 105' connected to an external water supply and a water outlet 106' connected to a water consumption device, such as a faucet, a first water heat exchanger 310' and a second water heat exchanger 320'.

The first water heat exchanger 310' may be connected to the compressor outlet 102' of the compressor 100' through at least one of the connecting pipes 1'. A predetermined amount of water may flow in the water tank 401' through the water inlet 105' and flow out of the water tank 401' through the water outlet 106'.

The air conditioning, heat pump and water heating system may be configured to selectively operate between at least an air conditioning mode and a heat pump mode, wherein in the air conditioning mode, a predetermined amount of vaporous refrigerant is arranged to leave the compressor 100' and guided to enter the first water heat exchanger 310' of the water heater 400' for releasing heat to the water flowing through the water heater 400', the refrigerant leaving the water heater may be guided to flow through the switching valve 600' and reach the outdoor heat exchanger 30' for releasing heat to ambient air. The refrigerant leaving the outdoor heat exchanger may be guided to flow through the refrigerant storage tank 180' and enter the indoor heat exchanging system 200' for absorbing heat from the heat exchange medium circulating in the indoor heat exchanging system 200'. The refrigerant leaving the indoor heat exchanger 200' may be guided to flow back to the compressor 100' to complete an air conditioning cycle.

When the air conditioning, heat pump and water heating system is in the heat pump mode, a predetermined amount of vaporous refrigerant may be arranged to leave the compressor 100' and guided to enter the first water heat exchanger 310' of the water heater 400' for releasing heat to the water flowing through the water heater 400'. The refrigerant leaving the water heater 400' may be guided to flow through the switching valve 600' and reach the indoor heat exchanging system 200' for releasing heat to the heat exchange medium circulating in the indoor heat exchanging system 200'. The refrigerant leaving the indoor heat exchanging system 200' may be guided to flow through the refrigerant storage tank 180' and enter the outdoor heat exchanger 300' for absorbing heat from the ambient air. The refrigerant leaving the outdoor heat exchanger 300' may be being guided to flow back to the compressor 100' to complete a heat pump cycle.

The above-mentioned components may be connected to form a particular configuration to allow refrigerant to perform heat exchange with various mediums such as ambient air. An exemplary configuration is shown in FIG. 4 of the drawings. According to the second preferred embodiment of the present invention, the outdoor heat exchanger 300' may be positioned in an outdoor environment so that it may draw ambient air for performing heat exchange with the refrigerant.

The second water heat exchanger 320' may be connected to the switching valve 600', the refrigerant storage tank 180', the outdoor heat exchanger 300' and the indoor heat exchanging system 200' through at least one of the connecting pipes 1'.

The air conditioning, heat pump and water heating system may also be configured to further selectively operate in a first water heating mode and a second water heating mode in addition to the air conditioning mode and the heat pump mode mentioned above. When the air conditioning, heat pump and water heating system operates in the first water heating mode, a predetermined amount of vaporous refrigerant may be arranged to leave the compressor and guided to enter the first water heat exchanger 310' of the water heater 400' for releasing heat to the water flowing through the water heater 400'. The refrigerant leaving the first water heat exchanger 310' may be guided to flow through the second water heat exchanger 320' for further releasing heat to the water flowing through the water heater 400'. The refrigerant leaving the second water heat exchanger 320' may be guided to flow through the refrigerant storage tank 180' and enter the indoor heat exchanging system 200' for absorbing heat from the heat exchange medium circulating in the indoor heat exchanging system 200'. The refrigerant leaving the indoor heat exchanging system 200' may be guided to flow back to the compressor 100' to complete a first water heating cycle. In this first water heating mode, heat in the indoor space may be utilized to heat up the water flowing in the water heater 400'.

When the air conditioning, heat pump and water heating system operates in the second water heating mode, a predetermined amount of vaporous refrigerant is arranged to leave the compressor 100' and guided to enter the first water heat exchanger 310' of the water heater 400' for releasing heat to the water flowing through the water heater 400'. The refrigerant leaving the first water heat exchanger 310' may be guided to flow through the second water heat exchanger 320' for further releasing heat to the water flowing through the water heater 400'. The refrigerant leaving the second water heat exchanger 320' may be guided to flow through the refrigerant storage tank 180' and enter the outdoor heat exchanger 300' for absorbing heat from the ambient air. The refrigerant leaving the outdoor heat exchanger 300' may be guided to flow back to the compressor 100' to complete a second water heating cycle. In his second water heating mode, heat from ambient environment may be absorbed and utilized to heat up water in the water heater 400'.

The switching valve 600' may comprise a first four-way valve 61' and a second four-way valve 62'. The first four-way valve 61' may have first through fourth connecting port 611', 612', 613', 614'. The first four-way valve 61' may be switched between a first operating mode and a second operating mode, wherein in the first operating mode, first four-way valve 61' is switched such that the first connecting port 611' may be connected to the second connecting port 612' so that refrigerant may flow from the first connecting port 611' to the second connecting port 612', while the third connecting port 613' may be connected to the fourth connecting port 614' so that refrigerant may flow from the third connecting port 613' to the fourth connecting port 614'.

In the second operating mode, the first four-way valve 61' may be switched so that the first connecting port 611' may be connected to the fourth connecting port 614' so that refrigerant may flow from the first connecting port 611' to the fourth connecting port 614', while the second connecting port 612' may be connected to the third connecting port 613', so that refrigerant may flow from the second connecting port 612' to the third connecting port 613'.

On the other hand, the second four-way valve 62' may have fifth through eighth connecting port 625', 626', 627', 628'. The second four-way valve 62' may be switched between a third operating mode and a fourth operating mode, wherein in the third operating mode, the second four-way valve 62' may be switched such that the fifth connecting port 625' may be connected to the sixth connecting port 626' so that refrigerant may flow from the fifth connecting port 625' to the sixth connecting port 626', while the seventh connecting port 627' may be connected to the eighth connecting port 628' so that refrigerant may flow from the seventh connecting port 627' to the eighth connecting port 628'.

In the fourth operating mode, the second four-way valve 62' may be switched so that the fifth connecting port 625' may be connected to the eighth connecting port 628' so that refrigerant may flow from the fifth connecting port 625' to the eighth connecting port 628', while the sixth connecting port 626' may be connected to the seventh connecting port 627', so that refrigerant may flow from the sixth connecting port 626' to the seventh connecting port 627'.

The outdoor heat exchanger 300' may have a first communicating port 10' and a second communicating port 11' for allowing refrigerant to flow into or out of the outdoor heat exchanger 300'. As shown in FIG. 4 of the drawings, the first communicating port 10' may be connected to the sixth connecting port 626' of the second four-way valve 62'. The second communicating port 11' may be connected to the refrigerant storage tank 180', the indoor heat exchanging system 200', and the water heater 400' through various other components (described below). The refrigerant flowing through the outdoor heat exchanger 300' may be arranged to perform heat exchange with the ambient air. The outdoor heat exchanger 300' may be configured to have a plurality of heat exchanging tubes and a plurality of heat exchanging fins for enhancing heat exchange performance of the outdoor heat exchanger 300'. The seventh connecting port 627' may be connected to the compressor inlet 101' of the compressor 100'.

The indoor heat exchanging system 200' may be utilized for performing heat exchange with another heat exchange medium circulating in an indoor heat distribution system. In this second preferred embodiment of the present invention, the indoor heat exchanging system 200 may comprise a plurality of fan coil units 201' connected or configured in parallel. Each of the fan coil units 201' may have a fan 2011' and a plurality of heat exchanging tubes 2012' for performing heat exchange. The heat exchanging tubes 2012' may allow refrigerant to pass through.

As shown in FIG. 4 of the drawings, the indoor heat exchanging system 200' may have a first passage port 13' and a second passage port 14' for allowing refrigerant to flow into or out of the indoor heat exchanging system 200'. The first passage port 13' may be connected to the second communicating port 11' of the outdoor heat exchanger 300', the refrigerant storage tank 180', and the water heater 400' through other auxiliary components (described below). The second passage port 14' may be connected to the eighth connecting port 628' of the second four-way value 62'. The heat exchanging tubes 2012' of each of the fan coil units 201' may be connected to the first passage port 13' and the second passage port 14' so that refrigerant may pass through the fan coil units 201' through the first passage port 13' and the second passage port 14'. Each of the fan coil units 201' may be positioned in a designated indoor space and the fan 2011' of each of the fan coil units 201' may draw air to flow through the heat exchanging tubes 2012' so as to facilitate heat exchange between the refrigerant and the air in the indoor space so as to condition the temperature of the corresponding indoor space.

The refrigerant storage tank 180' may have a liquid inlet 15' connected to the second communicating port 11' of the outdoor heat exchanger 300', the first passage port 13' of the indoor heat exchanging system 200', and the second water heat exchanger 320' of the water heater 400' through a plurality of auxiliary components (described below). The refrigerant storage tank 180' may further have a liquid outlet 16' connected to the second communicating port 11' and the first passage port 13' of the indoor heat exchanging system 200' through a plurality of auxiliary components (described below). The refrigerant storage tank 180' may be utilized for temporarily store a predetermined amount of refrigerant.

The air conditioning, heat pump and water heating system may further comprise a filter 150' connected to the liquid outlet 16' of the refrigerant storage tank 180', and an expansion valve 151' connected to the filter 150' and the second communicating port 11'.

The air conditioning, heat pump and water heating system may further comprise a unidirectional valve 21' for restricting the flow of the refrigerant in one predetermined direction. As shown in FIG. 4 of the drawings, the unidirectional valve 21' may be connected between the second water heat exchanger 320' of the water heater 400' and the liquid inlet 15' of the refrigerant storage tank 180'. The unidirectional valve 23' may be configured to allow a flow of refrigerant only in a direction from the second water heat exchanger 320' of the water heater 400' toward the liquid inlet 15' of the refrigerant storage tank 180', through Path 3 indicated in FIG. 4 of the drawings.

The air conditioning, heat pump and water heating system may further comprise a first electrically-controlled two-way valve 41' connected to the second communicating port 11' of the outdoor heat exchanger 300' and the liquid outlet 16' of the refrigerant storage tank 180' through the filter 150' and the expansion valve 151' in Path 5 indicated in FIG. 4 of the drawings.

The air conditioning, heat pump and water heating system may further comprise a second electrically-controlled two-way valve 42' connected to the first passage port 13' of the indoor heat exchanging system 200' and the first electrically-controlled two-way valve 41', the expansion valve 151' and the liquid outlet 16' through the filter 150'. The second electrically-controlled two-way valve 42' may be connected in Path 4 as indicated in FIG. 4 of the drawings. Refrigerant flowing from the liquid outlet 16' may be selectively guided to flow through the filter 150', and the second electrically-controlled two-way valve 42' and reach the first passage port 13'. Alternatively, refrigerant flowing from the liquid outlet 16' may also be selectively guided to flow through the filter 150', and the expansion valve 151' and the first electrically-controlled two-way valve 41' and reach the second communicating port 11' of the outdoor heat exchanger 300.

The air conditioning, heat pump and water heating system may further comprise a third electrically-controlled two-way valve 43' connected to the second communicating port 11' of the outdoor heat exchanger 300 and the liquid inlet 15' of the refrigerant storage tank 180'. As shown in FIG. 4 of the drawings, the third electrically-controlled two-way valve 43' and the first electrically-controlled two-way valve 41' may be connected in parallel.

The air conditioning, heat pump and water heating system may further comprise a fourth electrically-controlled two-way valve 44' connected to the first passage port 13' of the indoor heat exchanging system 200', the second electrically-controlled two-way valve 42', the liquid inlet 15' of the refrigerant storage tank 180', and the second water heaty exchanger 320' of the water heater 400'. The fourth electrically-controlled two-way valve 44' may be connected in Path 2 as indicated in FIG. 4 of the drawings.

Each of the first electrically-controlled two-way valve 41', the second electrically-controlled two-way valve 42', the third electrically-controlled two-way valve 43', and the fourth electrically-controlled two-way valve 44' may be selectively switched off for not allowing refrigerant to pass therethrough. They may also be selectively switched on for allowing refrigerant to pass therethrough in a predetermined direction.

When the air conditioning, heat pump and water heating system is in the air conditioning mode, the first four-way valve 61' may be switched to the first operating mode, while the second four-way valve 62' may be switched to the third operating mode. The first electrically-controlled two-way valve 41' and the fourth electrically-controlled two-way valve 44' may be turned off while the second electrically-controlled two-way valve 42' and the third electrically-controlled two-way valve 43' may be turned on.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'.

The refrigerant leaving the first water heat exchanger 310' may be guided to pass through the first connecting port 611', the second connecting port 612', the fifth connecting port 625' and the sixth connecting port 626' of the second four-way valve 62', and enter the first communicating port 10' of the outdoor heat exchanger 300'. The refrigerant may release heat to the ambient air when passing through the outdoor heat exchanger 300'. The refrigerant may then be guided to leave the outdoor heat exchanger 300' through the second communicating port 11' and may be guided to pass through the third electrically-controlled two-way valve 43' in Path 1 and enter the refrigerant storage tank 180' through the liquid inlet 15'. The refrigerant may then leave the refrigerant storage tank 180' through the liquid outlet 16' and may be guided to flow through the filter 150', the second electrically-controlled two-way valve 42' in Path 4, and enter the indoor heat exchanging system 200' through the first passage port 13'. The refrigerant may then absorb heat from the air passing through the fan coil units 201' so as to provide cooled air to the designated indoor spaces.

The refrigerant may then be arranged to leave the indoor heat exchanging system 200' through the second passage port 14' and pass through the eighth connecting port 628' and the seventh connecting port 627' of the second four-way valve 62', and eventually flow back to the compressor 100' through the compressor inlet 101' to complete an air conditioning cycle.

When the air conditioning, heat pump and water heating system is in the heat pump mode, the first four-way valve 61' may be switched to the first operating mode, while the second four-way valve 62' may be switched to the fourth operating mode. The first electrically-controlled two-way valve 41' and the fourth electrically-controlled two-way valve 44' may be turned on while the second electrically-controlled two-way valve 42' and the third electrically-controlled two-way valve 43' may be turned off.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'.

The refrigerant leaving the first water heat exchanger 310' may be guided to pass through the first connecting port 611', the second connecting port 612', the fifth connecting port 625' and the eighth connecting port 628' of the second four-way valve 62', and enter the second passage port 14' of the indoor heat exchanging system 200'. The refrigerant may then release heat to the air passing through the fan coil units 201' so as to provide heated air to the designated indoor spaces. The refrigerant may then be guided to leave the indoor heat exchanging system 200' through the first passage port 13' and may then be guided to pass through the fourth electrically-controlled two-way valve 44' in Path 2 and enter the refrigerant storage tank 180' through the liquid inlet 15'. The refrigerant may then leave the refrigerant storage tank 180' through the liquid outlet 16' and may be guided to flow through the filter 150', the expansion valve 151', the first electrically-controlled two-way valve 41' in Path 5, and enter the outdoor heat exchanger 300' through the second communicating port 11'. The refrigerant may then absorb heat from ambient air when passing through the outdoor heat exchanger 300'.

The refrigerant may then be arranged to leave the outdoor heat exchanger 300' through the first communicating port 10' and pass through the sixth connecting port 626' and the seventh connecting port 627' of the second four-way valve 62', and eventually flow back to the compressor 100'. through the compressor inlet 101 to complete a heat pump cycle.

When the air conditioning, heat pump and water heating system is in the first water heating mode, the first four-way valve 61' may be switched to the second operating mode, while the second four-way valve 62' may be switched to the fourth operating mode. The first electrically-controlled two-way valve 41', the third electrically-controlled two-way valve 43' and the fourth electrically-controlled two-way valve 44' may be turned off while the second electrically-controlled two-way valve 42' may be turned on.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'. The refrigerant leaving the first water heat exchanger 310' may be guided to pass through the first connecting port 611', the fourth connecting port 614', and enter the second water heat exchanger 320' through a second entry port 3201' for further releasing a certain amount of heat to the water flowing in the water heater 400'. The refrigerant may then be arranged to leave the second water heat exchanger 320' through a second exit port 3202' and may be guided to pass through the first unidirectional valve 21' in Path 3, and enter the refrigerant storage tank 180' through the liquid inlet 15'. The refrigerant may then leave the refrigerant storage tank 180' through the liquid outlet 16' and may be guided to flow through the filter 150', the second electrically-controlled two-way valve 42' in Path 4, and enter the indoor heat exchanging system 200' through the first passage port 13'. The refrigerant may then absorb heat from the air passing through the fan coil units 201'. Thus, the refrigerant may use the heat absorbed in the indoor spaces as a heat source to heat up the water in the water heater 400'.

The refrigerant may then be arranged to leave the indoor heat exchanging system 200' through the second passage port 14' and pass through the eighth connecting port 628' and the fifth connecting port 625' of the second four-way valve 62', and the second connecting port 612' and the third connecting port 613' of the first four-way valve 61', and eventually flow back to the compressor 100' through the compressor inlet 101' to complete a first water heating cycle.

It is worth mentioning that in this first water heating cycle, the outdoor heat exchanger 300' may become idle. Therefore, residual refrigerant in the outdoor heat exchanger 300' may be guided to flow back to the compressor 100' through the sixth connecting port 626' and the seventh connecting port 627' of the second four-way valve 62'.

When the air conditioning, heat pump and water heating system is in the second water heating mode, the first four-way valve 61' may be switched to the first operating mode, while the second four-way valve 62' may be switched to the fourth operating mode. The second electrically-controlled two-way valve 42', the third electrically-controlled two-way valve 43' and the fourth electrically-controlled two-way valve 44' may be turned off while the first electrically-controlled two-way valve 41' may be turned on.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'. The refrigerant leaving the first water heat exchanger 310' may be guided to pass through the first connecting port 611', the fourth connecting port 614', and enter the second water heat exchanger 320' through a second entry port 3201' for further releasing a certain amount of heat to the water flowing in the water heater 400'.

The refrigerant may then be arranged to leave the second water heat exchanger 320' through a second exit port 3202' and may be guided to pass through the first unidirectional valve 21' in Path 3, and enter the refrigerant storage tank 180' through the liquid inlet 15'. The refrigerant may then leave the refrigerant storage tank 180' through the liquid outlet 16' and may be guided to flow through the filter 150', the expansion valve 151', the first electrically-controlled two-way valve 41' in Path 5, and enter the outdoor heat exchanging system 300' through the second communicating port 11'. The refrigerant may then absorb heat from ambient air flowing through the outdoor heat exchanging system 300'. Thus, the refrigerant may use the heat from ambient air as a heat source to heat up the water in the water heater 400'.

The refrigerant may then be arranged to leave the outdoor heat exchanger 300' through the first communicating port 10' and pass through the sixth connecting port 626' and the seventh connecting port 627' of the second four-way valve 62', and eventually flow back to the compressor 100' through the compressor inlet 101' to complete a second water heating cycle.

It is also worth mentioning that all of the air conditioning mode, the heat pump mode, the first water heating mode and the second water heating mode may be utilized to produce heated water in the water heater 400'. However, in the former two modes of operations, supply of heated water may be less than that of the latter two modes.

Figure 5:
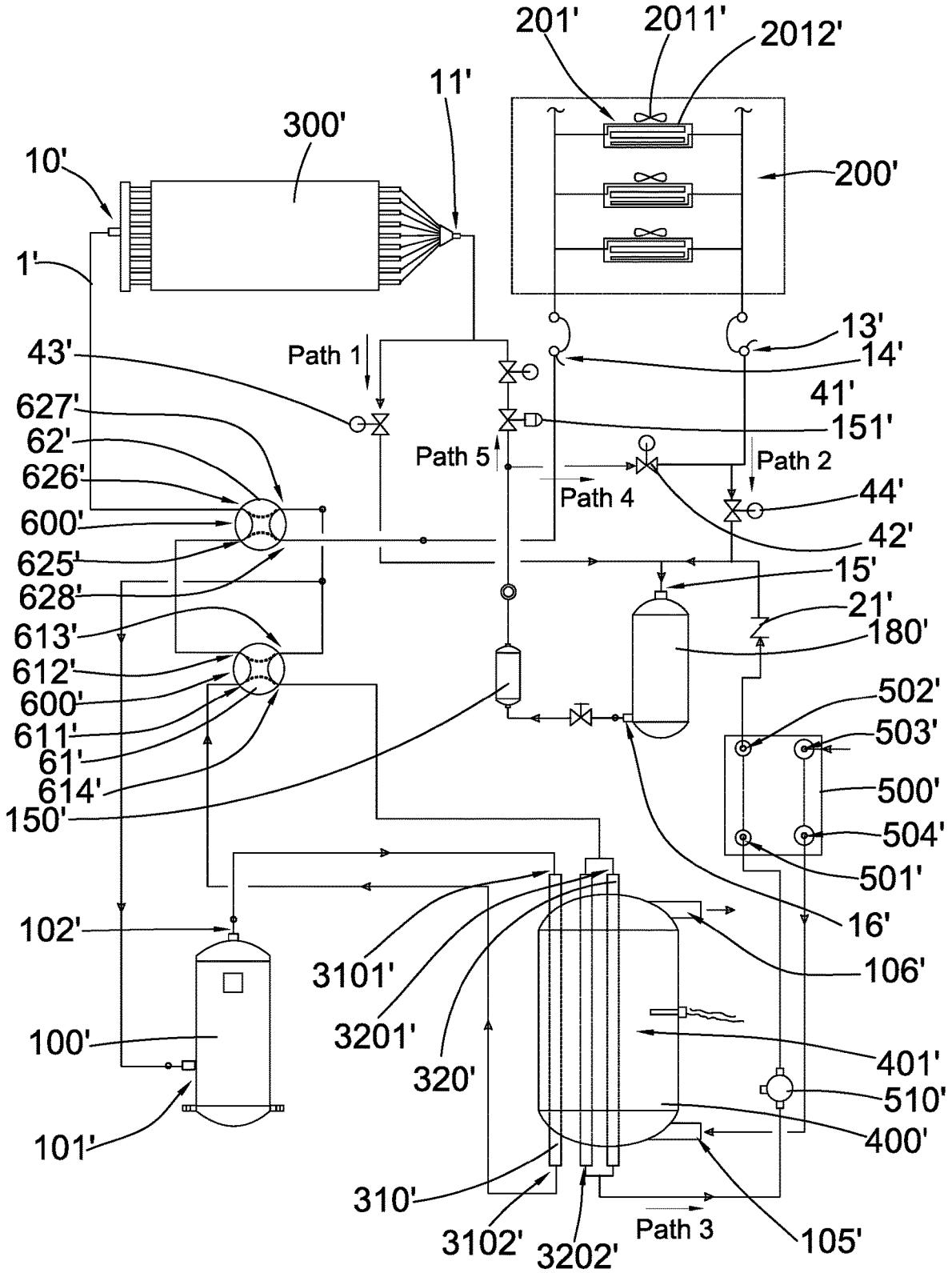
FIG. 5 is a schematic diagram of an air conditioning, heat pump and water heating system according to a first alternative mode of the second preferred embodiment of the present invention.

Referring to FIG. 5 of the drawings, an air conditioning, heat pump and water heating system according to an alternative mode of the second preferred embodiment of the present invention is illustrated. The alternative mode is identical to the configuration described in the second preferred embodiment as shown in FIG. 4 of the drawings, except the air conditioning, heat pump and water heating system may further comprise an energy saving heat exchanger 500' connected between the water heater 400' and the refrigerant storage tank 180'.

The energy saving heat exchanger 500' may have a first refrigerant port 501' connected to the second exit port 3202' of the second water heat exchanger 320' of the water heater 400', a second refrigerant port 502' connected to the liquid inlet 15' of the refrigerant storage tank 180' through the first unidirectional valve 21', a first water port 503' connected to an external water supply, and a second water port 504' connected to the water inlet 105' of the water heater 400'. The water outlet 106' of the water heater 400' may also be connected to a water consumption device.

Moreover, the air conditioning, heat pump and water heating system may further comprise a depressurizing device 510' connected between the second exit port 3202' of the second water heat exchanger 320' and the first refrigerant port 501' for decreasing a pressure of the refrigerant flowing through the depressurizing device 510'.

The purpose of having the energy saving heat exchanger 500' is to utilize the temperature of an external water source (such as water from a public water supply system) to lower the temperature of the refrigerant passing through the energy saving heat exchanger 500'. At the same time, water may be pre-heated by the refrigerant before entering the water heater 400'. This is an improvement over the second preferred embodiment described above because in the second preferred embodiment as shown in FIG. 4 of the drawings, the power source of the heat exchange may solely be provided by the work done by the compressor 100'. However, in this alternative mode, additional heat exchange may occur because of the inherent temperature difference between an external water source and the refrigerant.

The air conditioning, heat pump and water heating system may also be configured to selectively operate between air conditioning mode, a heat pump mode. The flow of the refrigerant in these two mode of operations are identical to what has been described in the second preferred embodiment above.

Broadly, when the air conditioning, heat pump and water heating system is in the first water heating mode, a predetermined amount of vaporous refrigerant may be arranged to leave the compressor and guided to enter the first water heat exchanger 310' of the water heater 400' for releasing heat to the water flowing through the water heater 400'. The refrigerant leaving the first water heat exchanger 310' may be guided to flow through the second water heat exchanger 320' for further releasing heat to the water flowing through the water heater 400'. The refrigerant leaving the second water heat exchanger 320' may be guided to flow through the energy saving heat exchanger 500', the refrigerant storage tank 180' and enter the indoor heat exchanging system 200' for absorbing heat from the another heat exchange medium (e.g. indoor air) flowing through the indoor heat exchanging system 200'. The refrigerant leaving the indoor heat exchanging system 200' may be guided to flow back to the compressor 100' to complete a first water heating cycle. In this first water heating mode, heat in the indoor space may be utilized to heat up the water flowing in the water heater 400'.

When the air conditioning, heat pump and water heating system operates in the second water heating mode, a predetermined amount of vaporous refrigerant is arranged to leave the compressor 100' and guided to enter the first water heat exchanger 310' of the water heater 400' for releasing heat to the water flowing through the water heater 400'. The refrigerant leaving the first water heat exchanger 310' may be guided to flow through the second water heat exchanger 320' for further releasing heat to the water flowing through the water heater 400'. The refrigerant leaving the second water heat exchanger 320' may be guided to flow through the energy saving heat exchanger 500', the refrigerant storage tank 180' and enter the outdoor heat exchanger 300' for absorbing heat from the ambient air. The refrigerant leaving the outdoor heat exchanger 300' may be guided to flow back to the compressor 100' to complete a second water heating cycle. In his second water heating mode, heat from ambient environment may be absorbed and utilized to heat up water in the water heater 400'.

The switching valve 600' may comprise a first four-way valve 61' and a second four-way valve 62'. The first four-way valve 61' may have first through fourth connecting port 611', 612', 613', 614'. The first four-way valve 61' may be switched between a first operating mode and a second operating mode, wherein in the first operating mode, first four-way valve 61' is switched such that the first connecting port 611' may be connected to the second connecting port 612' so that refrigerant may flow from the first connecting port 611' to the second connecting port 612', while the third connecting port 613' may be connected to the fourth connecting port 614' so that refrigerant may flow from the third connecting port 613' to the fourth connecting port 614'.

In the second operating mode, the first four-way valve 61' may be switched so that the first connecting port 611' may be connected to the fourth connecting port 614' so that refrigerant may flow from the first connecting port 611' to the fourth connecting port 614', while the second connecting port 612' may be connected to the third connecting port 613', so that refrigerant may flow from the second connecting port 612' to the third connecting port 613'.

On the other hand, the second four-way valve 62' may have fifth through eighth connecting port 625', 626', 627', 628'. The second four-way valve 62' may be switched between a third operating mode and a fourth operating mode, wherein in the third operating mode, the second four-way valve 62' may be switched such that the fifth connecting port 625' may be connected to the sixth connecting port 626' so that refrigerant may flow from the fifth connecting port 625' to the sixth connecting port 626', while the seventh connecting port 627' may be connected to the eighth connecting port 628' so that refrigerant may flow from the seventh connecting port 627' to the eighth connecting port 628'.

In the fourth operating mode, the second four-way valve 62' may be switched so that the fifth connecting port 625' may be connected to the eighth connecting port 628' so that refrigerant may flow from the fifth connecting port 625' to the eighth connecting port 628', while the sixth connecting port 626' may be connected to the seventh connecting port 627', so that refrigerant may flow from the sixth connecting port 626' to the seventh connecting port 627'.

Specifically referring to FIG. 5 of the drawings, when the air conditioning, heat pump and water heating system in the alternative mode of the second preferred embodiment is in the air conditioning mode, the first four-way valve 61' may be switched to the first operating mode, while the second four-way valve 62' may be switched to the third operating mode. The first electrically-controlled two-way valve 41' and the fourth electrically-controlled two-way valve 44' may be turned off while the second electrically-controlled two-way valve 42' and the third electrically-controlled two-way valve 43' may be turned on.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'.

The refrigerant leaving the first water heat exchanger 310' may be guided to pass through the first connecting port 611', the second connecting port 612', the fifth connecting port 625' and the sixth connecting port 626' of the second four-way valve 62', and enter the first communicating port 10' of the outdoor heat exchanger 300'. The refrigerant may release heat to the ambient air when passing through the outdoor heat exchanger 300'. The refrigerant may then be guided to leave the outdoor heat exchanger 300' through the second communicating port 11' and may be guided to pass through the third electrically-controlled two-way valve 43' in Path 1 and enter the refrigerant storage tank 180' through the liquid inlet 15'. The refrigerant may then leave the refrigerant storage tank 180' through the liquid outlet 16' and may be guided to flow through the filter 150', the second electrically-controlled two-way valve 42' in Path 4, and enter the indoor heat exchanging system 200' through the first passage port 13'. The refrigerant may then absorb heat from the air passing through the fan coil units 201' so as to provide cooled air to the designated indoor spaces.

The refrigerant may then be arranged to leave the indoor heat exchanging system 200' through the second passage port 14' and pass through the eighth connecting port 628' and the seventh connecting port 627' of the second four-way valve 62', and eventually flow back to the compressor 100' through the compressor inlet 101' to complete an air conditioning cycle.

When the air conditioning, heat pump and water heating system in the alternative mode of the second preferred embodiment is in the heat pump mode, the first four-way valve 61' may be switched to the first operating mode, while the second four-way valve 62' may be switched to the fourth operating mode. The first electrically-controlled two-way valve 41' and the fourth electrically-controlled two-way valve 44' may be turned on while the second electrically-controlled two-way valve 42' and the third electrically-controlled two-way valve 43' may be turned off.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'.

The refrigerant leaving the first water heat exchanger 310' may be guided to pass through the first connecting port 611', the second connecting port 612', the fifth connecting port 625' and the eighth connecting port 628' of the second four-way valve 62', and enter the second passage port 14' of the indoor heat exchanging system 200'. The refrigerant may then release heat to the air passing through the fan coil units 201' so as to provide heated air to the designated indoor spaces. The refrigerant may then be guided to leave the indoor heat exchanging system 200' through the first passage port 13' and may then be guided to pass through the fourth electrically-controlled two-way valve 44' in Path 2 and enter the refrigerant storage tank 180' through the liquid inlet 15'. The refrigerant may then leave the refrigerant storage tank 180' through the liquid outlet 16' and may be guided to flow through the filter 150', the expansion valve 151', the first electrically-controlled two-way valve 41' in Path 5, and enter the outdoor heat exchanger 300' through the second communicating port 11'. The refrigerant may then absorb heat from ambient air when passing through the outdoor heat exchanger 300'.

The refrigerant may then be arranged to leave the outdoor heat exchanger 300' through the first communicating port 10' and pass through the sixth connecting port 626' and the seventh connecting port 627' of the second four-way valve 62', and eventually flow back to the compressor 100'. through the compressor inlet 101 to complete a heat pump cycle.

When the air conditioning, heat pump and water heating system in the alternative mode of the second preferred embodiment is in the first water heating mode, the first four-way valve 61' may be switched to the second operating mode, while the second four-way valve 62' may be switched to the fourth operating mode. The first electrically-controlled two-way valve 41', the third electrically-controlled two-way valve 43' and the fourth electrically-controlled two-way valve 44' may be turned off while the second electrically-controlled two-way valve 42' may be turned on.

Referring to FIG. 5 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'. The refrigerant leaving the first water heat exchanger 310' may be guided to pass through the first connecting port 611', the fourth connecting port 614', and enter the second water heat exchanger 320' through a second entry port 3201' for further releasing a certain amount of heat to the water flowing in the water heater 400'. The refrigerant may then be arranged to leave the second water heat exchanger 320' through a second exit port 3202' and may be guided to pass through the first refrigerant port 501' of the energy saving heat exchanger 500' for releasing heat to the water flowing through the energy saving heat exchanger 500'. The refrigerant may then leave the energy saving heat exchanger 500' through the second refrigerant port 502' and may be guided to flow through the first unidirectional valve 21' in Path 3, and enter the refrigerant storage tank 180' through the liquid inlet 15'. The refrigerant may then leave the refrigerant storage tank 180' through the liquid outlet 16' and may be guided to flow through the filter 150', the second electrically-controlled two-way valve 42' in Path 4, and enter the indoor heat exchanging system 200' through the first passage port 13'. The refrigerant may then absorb heat from the air passing through the fan coil units 201'. Thus, the refrigerant may use the heat absorbed in the indoor spaces as a heat source to heat up the water in the water heater 400'.

The refrigerant may then be arranged to leave the indoor heat exchanging system 200' through the second passage port 14' and pass through the eighth connecting port 628' and the fifth connecting port 625' of the second four-way valve 62', and the second connecting port 612' and the third connecting port 613' of the first four-way valve 61', and eventually flow back to the compressor 100' through the compressor inlet 101' to complete a first water heating cycle.

Water from an external water source may be guided to enter the energy saving heat exchanger 500' through the first water port 503'. The water may perform heat exchange with the refrigerant passing through the energy saving heat exchanger 500' and absorb heat from the refrigerant. Thus, the water may be preheated before entering the water heater 400'. The water may then leave the energy saving heat exchanger 500' through the second water port 504' and enter the water heater 400' through the water inlet 105'. The water may further be heated by the first water heat exchanger 310' and/or the second water heat exchanger 320' and exit the water heater 400' through the water outlet 106' for consumption by users.

In this first water heating cycle, the outdoor heat exchanger 300 may become idle. Therefore, residual refrigerant in the outdoor heat exchanger 300' may be guided to flow back to the compressor 100' through the sixth connecting port 626' and the seventh connecting port 627' of the second four-way valve 62'.

When the air conditioning, heat pump and water heating system in the alternative mode of the second preferred embodiment is in the second water heating mode, the first four-way valve 61' may be switched to the first operating mode, while the second four-way valve 62' may be switched to the fourth operating mode. The second electrically-controlled two-way valve 42', the third electrically-controlled two-way valve 43' and the fourth electrically-controlled two-way valve 44' may be turned off while the first electrically-controlled two-way valve 41' may be turned on.

Referring to FIG. 4 the drawings, a predetermined amount of vaporous refrigerant is arranged to leave the compressor 100' through the compressor outlet 102' and may be guided to enter the first water heat exchanger 310' through a first entry port 3101' for releasing a certain amount of heat to the water flowing in the water heater 400'. The refrigerant may then be guided to leave the first water heat exchanger 310' through a first exit port 3102'. The refrigerant leaving the first water heat exchanger 310' may be guided to pass through the first connecting port 611', the fourth connecting port 614', and enter the second water heat exchanger 320' through a second entry port 3201' for further releasing a certain amount of heat to the water flowing in the water heater 400'.

The refrigerant may then be arranged to leave the second water heat exchanger 320' through a second exit port 3202' and may be guided to pass through the first refrigerant port 501' of the energy saving heat exchanger 500' for releasing heat to the water flowing through the energy saving heat exchanger 500'. The refrigerant may then leave the energy saving heat exchanger 500' through the second refrigerant port 502' and may be guided to flow through the first unidirectional valve 21' in Path 3, and enter the refrigerant storage tank 180' through the liquid inlet 15'. The refrigerant may then leave the refrigerant storage tank 180' through the liquid outlet 16' and may be guided to flow through the filter 150', the expansion valve 151', the first electrically-controlled two-way valve 41' in Path 5, and enter the outdoor heat exchanging system 300' through the second communicating port 11'. The refrigerant may then absorb heat from ambient air flowing through the outdoor heat exchanging system 300'. Thus, the refrigerant may use the heat from ambient air as a heat source to heat up the water in the water heater 400'.

The refrigerant may then be arranged to leave the outdoor heat exchanger 300' through the first communicating port 10' and pass through the sixth connecting port 626' and the seventh connecting port 627' of the second four-way valve 62', and eventually flow back to the compressor 100' through the compressor inlet 101' to complete a second water heating cycle.

Again, water from an external water source may be guided to enter the energy saving heat exchanger 500' through the first water port 503'. The water may perform heat exchange with the refrigerant passing through the energy saving heat exchanger 500' and absorb heat from the refrigerant. Thus, the water may be preheated before entering the water heater 400'. The water may then leave the energy saving heat exchanger 500' through the second water port 504' and enter the water heater 400' through the water inlet 105'. The water may further be heated by the first water heat exchanger 310' and/or the second water heat exchanger 320' and exit the water heater 400' through the water outlet 106' for consumption by users.

All of the air conditioning mode, the heat pump mode, the first water heating mode and the second water heating mode may be utilized to produce heated water in the water heater 400'. However, in the former two modes of operations, supply of heated water may be less than that of the latter two modes.

The present invention, while illustrated and described in terms of the preferred embodiments and several alternatives, is not limited to the particular description contained in this specification. Additional alternative or equivalent components could also be used to practice the present invention.

What is claimed is:

1. An air conditioning, heat pump and water heating system, comprising:

a plurality of connecting pipes;

at least one compressor having a compressor inlet and a compressor outlet;

a switching valve connected to said compressor inlet of said compressor through at least one of said connecting pipes;

an outdoor heat exchanger positioned in outdoor space and connected to said switching valve through at least one of said connecting pipes;

a refrigerant storage tank connected to said outdoor heat exchanger through at least one of said connecting pipes;

an indoor heat exchanger connected to said outdoor heat exchanger and said refrigerant storage tank through at least one of said connecting pipes, said indoor heat exchanger being arranged to perform heat exchange with a heat exchange medium circulating through an indoor device; and a water heater, which comprises:

a water tank having a water inlet and a water outlet; and a first water heat exchanger connected to said compressor outlet of said compressor through at least one of said connecting pipes, a predetermined amount of water flowing in said water tank through said water inlet, and flowing out of said water tank through said water outlet;

said air conditioning, heat pump and water heating system being configured to selectively operate between at least an air conditioning mode and a heat pump mode, wherein in said air conditioning mode, a predetermined amount of vaporous refrigerant is arranged to leave said compressor and is guided to enter said first water heat exchanger of said water heater for releasing heat to said water flowing through said water heater, said refrigerant leaving said water heater being guided to flow through said switching valve and reach said outdoor heat exchanger for releasing heat to ambient air, said refrigerant leaving said outdoor heat exchanger being guided to flow through said refrigerant storage tank and enter said indoor heat exchanger for absorbing heat from said heat exchange medium circulating in said indoor heat exchanger, said refrigerant leaving said indoor heat exchanger being guided to flow back to said compressor to complete an air conditioning cycle, wherein in said heat pump mode, a predetermined amount of vaporous refrigerant is arranged to leave said compressor and is guided to enter said first water heat exchanger of said water heater for releasing heat to said water flowing through said water heater, said refrigerant leaving said water heater being guided to flow through said switching valve and reach said indoor heat exchanger for releasing heat to said heat exchange medium circulating in said indoor heat exchanger, said refrigerant leaving said indoor heat exchanger being guided to flow through said refrigerant storage tank and enter said outdoor heat exchanger for absorbing heat from said ambient air, said refrigerant leaving said outdoor heat exchanger being guided to flow back to said compressor to complete a heat pump cycle.

2. The air conditioning, heat pump and water heating system, as recited in claim 1, wherein said water heater further comprises a second water heat exchanger received in said water tank, said second water heat exchanger connecting to said switching valve, said refrigerant storage tank, said outdoor heat exchanger and said indoor heat exchanger through at least one of said connecting pipes.

3. The air conditioning, heat pump and water heating system, as recited in claim 2, being configured to further selectively operate between a first water heating mode, wherein in said first water heating mode, a predetermined amount of vaporous refrigerant is arranged to leave said compressor and guided to enter said first water heat exchanger of said water heater for releasing heat to said water flowing through said water heater, said refrigerant leaving said first water heat exchanger being guided to flow through said second water heat exchanger for further releasing heat to said water flowing through said water heater, said refrigerant leaving said second water heat exchanger being guided to flow through said refrigerant storage tank and enter said indoor heat exchanger for absorbing heat from said heat exchange medium circulating in said indoor heat exchanging system, said refrigerant leaving said indoor heat exchanger being guided to flow back to said compressor to complete a first water heating cycle.

4. The air conditioning, heat pump and water heating system, as recited in claim 3, being configured to further selectively operate between said first water heating mode and a second water heating mode, wherein in said second water heating mode, a predetermined amount of vaporous refrigerant is arranged to leave said compressor and is guided to enter said first water heat exchanger of said water heater for releasing heat to said water flowing through said water heater, said refrigerant leaving said first water heat exchanger being guided to flow through said second water heat exchanger for further releasing heat to said water flowing through said water heater, said refrigerant leaving said second water heat exchanger being guided to flow through said refrigerant storage tank and enter said outdoor heat exchanger for absorbing heat from said ambient air, said refrigerant leaving said outdoor heat exchanger being guided to flow back to said compressor to complete a second water heating cycle.

5. The air conditioning, heat pump and water heating system, as recited in claim 4, wherein said switching valve comprises a first four-way valve having first through fourth connecting ports and being arranged to be switched between a first operating mode and a second operating mode, wherein in said first operating mode, said first four-way valve is switched such that said first connecting port is connected to said second connecting port, while said third connecting port is connected to said fourth connecting port, wherein in said second operating mode, said first four-way valve is switched so that said first connecting port is connected to said fourth connecting port, while said second connecting port is connected to said third connecting port.

6. The air conditioning, heat pump and water heating system, as recited in claim 5, wherein said switching valve further comprises a second four-way valve having fourth through eighth connecting ports and being arranged to be switched between a third operating mode and a fourth operating mode, wherein in said third operating mode, said second four-way valve is switched such that said fifth connecting port is connected to said sixth connecting port, while said seventh connecting port is connected to said eighth connecting port, wherein in said fourth operating mode, said second four-way valve is switched so that said fifth connecting port is connected to said eighth connecting port, while said sixth connecting port is connected to said seventh connecting port.

7. The air conditioning, heat pump and water heating system, as recited in claim 6, wherein said outdoor heat exchanger has a first communicating port connected to said sixth connecting port of said second four-way valve, and a second communicating port connected to said refrigerant storage tank, said indoor heat exchanger, and said water heater.

8. The air conditioning, heat pump and water heating system, as recited in claim 7, wherein said indoor heat exchanger has a first passage port connected to said second communicating port of said outdoor heat exchanger, said refrigerant storage tank, and said water heater, and a second passage port connected to said eighth connecting port of said second four-way value.

9. The air conditioning, heat pump and water heating system, as recited in claim 8, wherein said refrigerant storage tank has a liquid inlet connected to said second communicating port of said outdoor heat exchanger, said first passage port of said indoor heat exchanger, and said second water heat exchanger of said water heater, said refrigerant storage tank further having a liquid outlet connected to said second communicating port of said outdoor heat exchanger and said first passage port of said indoor heat exchanger.

10. The air conditioning, heat pump and water heating system, as recited in claim 9, further comprising a first unidirectional valve connected between said second communicating port of said outdoor heat exchanger and said liquid inlet of said refrigerant storage tank, said first unidirectional valve being configured to allow a flow of refrigerant only in a direction from said second communicating port of said outdoor heat exchanger toward said liquid inlet of said refrigerant storage tank.

11. The air conditioning, heat pump and water heating system, as recited in claim 10, further comprising a second unidirectional valve connected between said first passage port of said indoor heat exchanger and said liquid inlet of said refrigerant storage tank, said second unidirectional valve being configured to allow a flow of refrigerant only in a direction from said first passage port of said indoor heat exchanger toward said liquid inlet of said refrigerant storage tank.

12. The air conditioning, heat pump and water heating system, as recited in claim 11, further comprising a third unidirectional valve connected between said second water heat exchanger of said water heater and said liquid inlet of said refrigerant storage tank, said third unidirectional valve being configured to allow a flow of refrigerant only in a direction from said second water heat exchanger of said water heater toward said liquid inlet of said refrigerant storage tank.

13. The air conditioning, heat pump and water heating system, as recited in claim 12, further comprising a first electrically-controlled two-way valve connected to said second communicating port of said outdoor heat exchanger and said liquid outlet of said refrigerant storage tank, a second electrically-controlled two-way valve connected to said first passage port of said indoor heat exchanger and said first electrically-controlled two-way valve, said first electrically-controlled two-way valve and said first unidirectional valve being connected in parallel, each of said first electrically-controlled two-way valve and said second electrically-controlled two-way valve is arranged to be selectively switched off for not allowing refrigerant to pass therethrough, and selectively switched on for allowing refrigerant to pass therethrough.

14. The air conditioning, heat pump and water heating system, as recited in claim 13, wherein when in said air conditioning mode, said first four-way valve is switched to said first operating mode, while said second four-way valve is switched to said third operating mode, said first electrically-controlled two-way valve being turned off while said second electrically-controlled two-way valve being turned on.

15. The air conditioning, heat pump and water heating system, as recited in claim 14, wherein in said heat pump mode, said first four-way valve being switched to said first operating mode, while said second four-way valve being switched to said fourth operating mode, said first electrically-controlled two-way valve being turned on while said second electrically-controlled two-way valve being turned off.

16. The air conditioning, heat pump and water heating system, as recited in claim 14, wherein in said first water heating mode, said first four-way valve being switched to said second operating mode, while said second four-way valve being switched to said fourth operating mode, said first electrically-controlled two-way valve being turned off while said second electrically-controlled two-way valve being turned on.

17. The air conditioning, heat pump and water heating system, as recited in claim 14, wherein in said second water heating mode, said first four-way valve being switched to said first operating mode, while said second four-way valve being switched to said fourth operating mode, said first electrically-controlled two-way valve being turned on while said second electrically-controlled two-way valve being turned off.

18. The air conditioning, heat pump and water heating system, as recited in claim 2, further comprising an energy saving heat exchanger connected between said water heater and said refrigerant storage tank, said energy saving heat exchanger having a first refrigerant port connected to said second water heat exchanger of said water heater, a second refrigerant port connected to said refrigerant storage tank, a first water port connected to an external water supply, and a second water port connected to said water inlet of said water heater.

19. The air conditioning, heat pump and water heating system, as recited in claim 9, further comprising an energy saving heat exchanger connected between said water heater and said refrigerant storage tank, said energy saving heat exchanger having a first refrigerant port connected to said second water heat exchanger of said water heater, a second refrigerant port connected to said liquid inlet of said refrigerant storage tank, a first water port connected to an external water supply, and a second water port connected to said water inlet of said water heater.

20. The air conditioning, heat pump and water heating system, as recited in claim 17, further comprising an energy saving heat exchanger connected between said water heater and said refrigerant storage tank, said energy saving heat exchanger having a first refrigerant port connected to said second water heat exchanger of said water heater, a second refrigerant port connected to said liquid inlet of said refrigerant storage tank, a first water port connected to an external water supply, and a second water port connected to said water inlet of said water heater.

21. The air conditioning, heat pump and water heating system, as recited in claim 9, wherein said indoor heat exchanger comprises a plurality of fan coils units connected in parallel and connected to said first passage port and said second passage port.

22. The air conditioning, heat pump and water heating system, as recited in claim 21, further comprising a unidirectional valve connected between said second water heat exchanger of said water heater and said liquid inlet of said refrigerant storage tank, said unidirectional valve being configured to allow a flow of refrigerant only in a direction from said second water heat exchanger of said water heater toward said liquid inlet of said refrigerant storage tank.

23. The air conditioning, heat pump and water heating system, as recited in claim 22, further comprising a first electrically-controlled two-way valve connected to said second communicating port of said outdoor heat exchanger and said liquid outlet of said refrigerant storage tank, said first electrically-controlled two-way valve being selectively switched off for not allowing refrigerant to pass therethrough, and selectively switched on for allowing refrigerant to pass therethrough.

24. The air conditioning, heat pump and water heating system, as recited in claim 23, further comprising a second electrically-controlled two-way valve connected to said first passage port of said indoor heat exchanger and said first electrically-controlled two-way valve, and said liquid outlet of said refrigerant storage tank, said second electrically-controlled two-way valve being selectively switched off for not allowing refrigerant to pass therethrough, and selectively switched on for allowing refrigerant to pass therethrough.

25. The air conditioning, heat pump and water heating system, as recited in claim 24, further comprising a third electrically-controlled two-way valve connected to said second communicating port of said outdoor heat exchanger and said liquid inlet of said refrigerant storage tank, said third electrically-controlled two-way valve and said first electrically-controlled two-way valve being connected in parallel, said third electrically-controlled two-way valve being selectively switched off for not allowing refrigerant to pass therethrough, and selectively switched on for allowing refrigerant to pass therethrough.

26. The air conditioning, heat pump and water heating system, as recited in claim 25, further comprising a fourth electrically-controlled two-way valve connected to said indoor heat exchanger, said second electrically-controlled two-way valve, said liquid inlet of said refrigerant storage tank, and said second water heat exchanger of said water heater, said fourth electrically-controlled two-way valve being selectively switched off for not allowing refrigerant to pass therethrough, and selectively switched on for allowing refrigerant to pass therethrough.

27. The air conditioning, heat pump and water heating system, as recited in claim 26, wherein in said air conditioning mode, said first four-way valve is switched to said first operating mode, while said second four-way valve is switched to said third operating mode, said first electrically-controlled two-way valve and said fourth electrically-controlled two-way valve are turned off while said second electrically-controlled two-way valve and said third electrically-controlled two-way valve are turned on.

28. The air conditioning, heat pump and water heating system, as recited in claim 27, wherein in said heat pump mode, said first four-way valve is switched to said first operating mode, while said second four-way valve is switched to said fourth operating mode, said first electrically-controlled two-way valve and said fourth electrically-controlled two-way valve are turned on while said second electrically-controlled two-way valve and said third electrically-controlled two-way valve are turned off.

29. The air conditioning, heat pump and water heating system, as recited in claim 28, wherein in said first water heating mode, said first four-way valve is switched to said second operating mode, while said second four-way valve is switched to said fourth operating mode, said first electrically-controlled two-way valve, said third electrically-controlled two-way valve and said fourth electrically-controlled two-way valve are turned off while said second electrically-controlled two-way valve is turned on.

30. The air conditioning, heat pump and water heating system, as recited in claim 29, wherein in said second water heating mode, said first four-way valve is switched to said first operating mode, while said second four-way valve is switched to said fourth operating mode, said second electrically-controlled two-way valve, said third electrically-controlled two-way valve and said fourth electrically-controlled two-way valve are turned off while said first electrically-controlled two-way valve is turned on.

31. The air conditioning, heat pump and water heating system, as recited in claim 21, further comprising an energy saving heat exchanger connected between said water heater and said refrigerant storage tank, said energy saving heat exchanger having a first refrigerant port connected to said second water heat exchanger of said water heater, a second refrigerant port connected to said refrigerant storage tank, a first water port connected to an external water supply, and a second water port connected to said water inlet of said water heater.

32. The air conditioning, heat pump and water heating system, as recited in claim 30, further comprising an energy saving heat exchanger connected between said water heater and said refrigerant storage tank, said energy saving heat exchanger having a first refrigerant port connected to said second water heat exchanger of said water heater, a second refrigerant port connected to said liquid inlet of said refrigerant storage tank, a first water port connected to an external water supply, and a second water port connected to said water inlet of said water heater.

* * * * *